US011813862B2

(12) United States Patent
Yajima et al.

(10) Patent No.: US 11,813,862 B2
(45) Date of Patent: Nov. 14, 2023

(54) LIQUID EJECTING APPARATUS AND DRIVE METHOD OF LIQUID EJECTING APPARATUS

(71) Applicant: Seiko Epson Corporation, Tokyo (JP)

(72) Inventors: Mikiya Yajima, Matsumoto (JP); Shinichi Itaya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 17/466,295

(22) Filed: Sep. 3, 2021

(65) Prior Publication Data

US 2022/0072856 A1 Mar. 10, 2022

(30) Foreign Application Priority Data

Sep. 7, 2020 (JP) ..... 2020-149657

(51) Int. Cl.
*B41J 2/045* (2006.01)
*B41J 2/14* (2006.01)

(52) U.S. Cl.
CPC ..... *B41J 2/04588* (2013.01); *B41J 2/04528* (2013.01); *B41J 2/04563* (2013.01); *B41J 2/04581* (2013.01); *B41J 2/04596* (2013.01)

(58) Field of Classification Search
CPC ..... B41J 2/04528
See application file for complete search history.

(56) References Cited

U.S. PATENT DOCUMENTS 6,128,098 A * 10/2000 Kamada ..... B41J 2/04591 347/49
6,270,180 B1 8/2001 Arakawa et al.
2001/0004263 A1* 6/2001 Ishinaga ..... B41J 2/04541 347/17
2014/0240386 A1* 8/2014 Hagiwara ..... B41J 2/04563 347/14
2015/0116400 A1* 4/2015 Sasaki ..... B41J 2/155 347/10
2018/0134034 A1* 5/2018 Fukuda ..... B41J 2/0455

FOREIGN PATENT DOCUMENTS

JP H09-141849 6/1997
JP H11-138797 5/1999
JP H11-138798 5/1999
JP 2011-136460 7/2011

* cited by examiner

*Primary Examiner* — Shelby L Fidler
(74) *Attorney, Agent, or Firm* — WORKMAN NYDEGGER

(57) ABSTRACT

A liquid ejecting apparatus includes an ejection section that includes a nozzle which ejects a liquid, a pressure chamber which communicates with the nozzle, and a piezoelectric actuator which imparts a pressure fluctuation to the liquid in the pressure chamber, a drive waveform generation section that generates a drive waveform including a non-ejection vibration pulse which, when supplied to the piezoelectric actuator, imparts the pressure fluctuation to the liquid in the pressure chamber such that the liquid is not ejected from the nozzle and a control section that controls supply of the non-ejection vibration pulse to the piezoelectric actuator in accordance with a temperature of the liquid in the pressure chamber.

14 Claims, 11 Drawing Sheets

LIQUID EJECTING APPARATUS AND DRIVE METHOD OF LIQUID EJECTING APPARATUS

The present application is based on, and claims priority from JP Application Serial Number 2020-149657, filed Sep. 7, 2020, the disclosure of which is hereby incorporated by reference herein in its entirety.

BACKGROUND

1. Technical Field

The present disclosure relates to a liquid ejecting apparatus that ejects a liquid and a drive method thereof, particularly, an ink jet type recording apparatus that ejects an ink as a liquid and a drive method of the liquid ejecting apparatus.

2. Related Art

A liquid ejecting apparatus is a device including an ejection section and ejects various liquids as liquid droplets from the ejection section. As this liquid ejecting apparatus, for example, there is an image recording apparatus, such as an ink jet type printer and an ink jet type plotter. Recently, the liquid ejecting apparatus is applied to various types of manufacturing apparatuses by taking advantage of the feature that a very small amount of liquids can be accurately landed at a predetermined position.

When the liquid is ejected from such an ejection section, the ejection characteristics change depending on a viscosity of the liquid. Since the viscosity of the liquid has a correlation with a temperature, the viscosity increases as the temperature decreases, and the viscosity decreases as the temperature increases. Therefore, when the ejection section designed to be suitable for the viscosity of the liquid generally used is placed in a low temperature environment or ejects the liquid having a high viscosity, it is necessary to heat the liquid in order to obtain desired ejection characteristics. A configuration in which a heater is provided in the ejection section for heating the liquid is disclosed (see, for example, JP-A-2011-136460).

However, when the heater for heating is provided, there is a problem that a structure of the liquid ejecting apparatus is complicated. Further, in the configuration in which the heater for heating is provided, a space for disposing the heater is required, and thus there is a problem that size reduction is difficult.

Note that such a problem is present in the liquid ejecting apparatus that ejects the liquid other than the ink, in addition to the ink jet type recording apparatus.

SUMMARY

An advantage of some aspects of the present disclosure is to provide a liquid ejecting apparatus and a drive method of a liquid ejecting apparatus which can heat a liquid and reduce a size without complicating a structure thereof.

According to an aspect of the present disclosure, there is provided a liquid ejecting apparatus including an ejection section that includes a nozzle which ejects a liquid, a pressure chamber which communicates with the nozzle, and a piezoelectric actuator which imparts a pressure fluctuation to the liquid in the pressure chamber, a drive waveform generation section that generates a drive waveform including a non-ejection vibration pulse which, when supplied to the piezoelectric actuator, imparts the pressure fluctuation to the liquid in the pressure chamber such that the liquid is not ejected from the nozzle, and a control section that controls supply of the non-ejection vibration pulse to the piezoelectric actuator in accordance with a temperature of the liquid in the pressure chamber.

According to another aspect of the present disclosure, there is provided a liquid ejecting apparatus including an ejection section that includes a nozzle which ejects a liquid, a pressure chamber which communicates with the nozzle, and a piezoelectric actuator which imparts a pressure fluctuation to the liquid in the pressure chamber, a drive waveform generation section that generates drive waveforms including a first drive waveform including a non-ejection vibration pulse which, when supplied to the piezoelectric actuator, imparts the pressure fluctuation to the liquid in the pressure chamber such that the liquid is not ejected from the nozzle and a second drive waveform including an in-printing non-ejection vibration pulse which, when supplied to the piezoelectric actuator, imparts the pressure fluctuation to the liquid in the pressure chamber such that the liquid is not ejected from the nozzle and an ejection vibration pulse which, when supplied to the piezoelectric actuator, imparts the pressure fluctuation to the liquid in the pressure chamber such that the liquid is ejected from the nozzle, a selection section that selects one of supply and non-supply of the drive waveforms to the piezoelectric actuator, a temperature detection section that detects a temperature of the liquid, and a control section that controls the selection section, in a printing operation period during which an image is printed on a printing medium in accordance with printing data, such that one of the in-printing non-ejection vibration pulse and the ejection vibration pulse is supplied to the piezoelectric actuator in accordance with the printing data and controls the selection section, in a standby period other than the printing operation period, such that the non-ejection vibration pulse is supplied to the piezoelectric actuator in accordance with a result of detection by the temperature detection section.

According to still another aspect of the present disclosure, there is provided a drive method of a liquid ejecting apparatus including an ejection section that includes a nozzle which ejects a liquid, a pressure chamber which communicates with the nozzle, and a piezoelectric actuator which imparts a pressure fluctuation to the liquid in the pressure chamber and a drive waveform generation section that generates a drive waveform including a non-ejection vibration pulse which, when supplied to the piezoelectric actuator, imparts the pressure fluctuation to the liquid in the pressure chamber such that the liquid is not ejected from the nozzle, the method including controlling supply of the non-ejection vibration pulse to the piezoelectric actuator in accordance with a temperature of the liquid in the pressure chamber.

According to still another aspect of the present disclosure, there is provided a drive method of a liquid ejecting apparatus including an ejection section that includes a nozzle which ejects a liquid, a pressure chamber which communicates with the nozzle, and a piezoelectric actuator which imparts a pressure fluctuation to the liquid in the pressure chamber, a drive waveform generation section that generates drive waveforms including a first drive waveform including a non-ejection vibration pulse which, when supplied to the piezoelectric actuator, imparts the pressure fluctuation to the liquid in the pressure chamber such that the liquid is not ejected from the nozzle and a second drive waveform including an in-printing non-ejection vibration pulse which, when supplied to the piezoelectric actuator, imparts the pressure fluctuation to the liquid in the pressure chamber such that the liquid is not ejected from the nozzle and an ejection vibration pulse which, when supplied to the piezoelectric actuator, imparts the pressure fluctuation to the liquid in the pressure chamber such that the liquid is ejected from the nozzle, and a temperature detection section that detects a temperature of the liquid, the method including supplying, in a printing operation period during which an image is printed on a printing medium in accordance with printing data, one of the in-printing non-ejection vibration pulse and the ejection vibration pulse to the piezoelectric actuator in accordance with the printing data and supplying, in a standby period other than the printing operation period, the non-ejection vibration pulse to the piezoelectric actuator in accordance with a result of detection by the temperature detection section.

DESCRIPTION OF EXEMPLARY EMBODIMENTS

Figure 1:
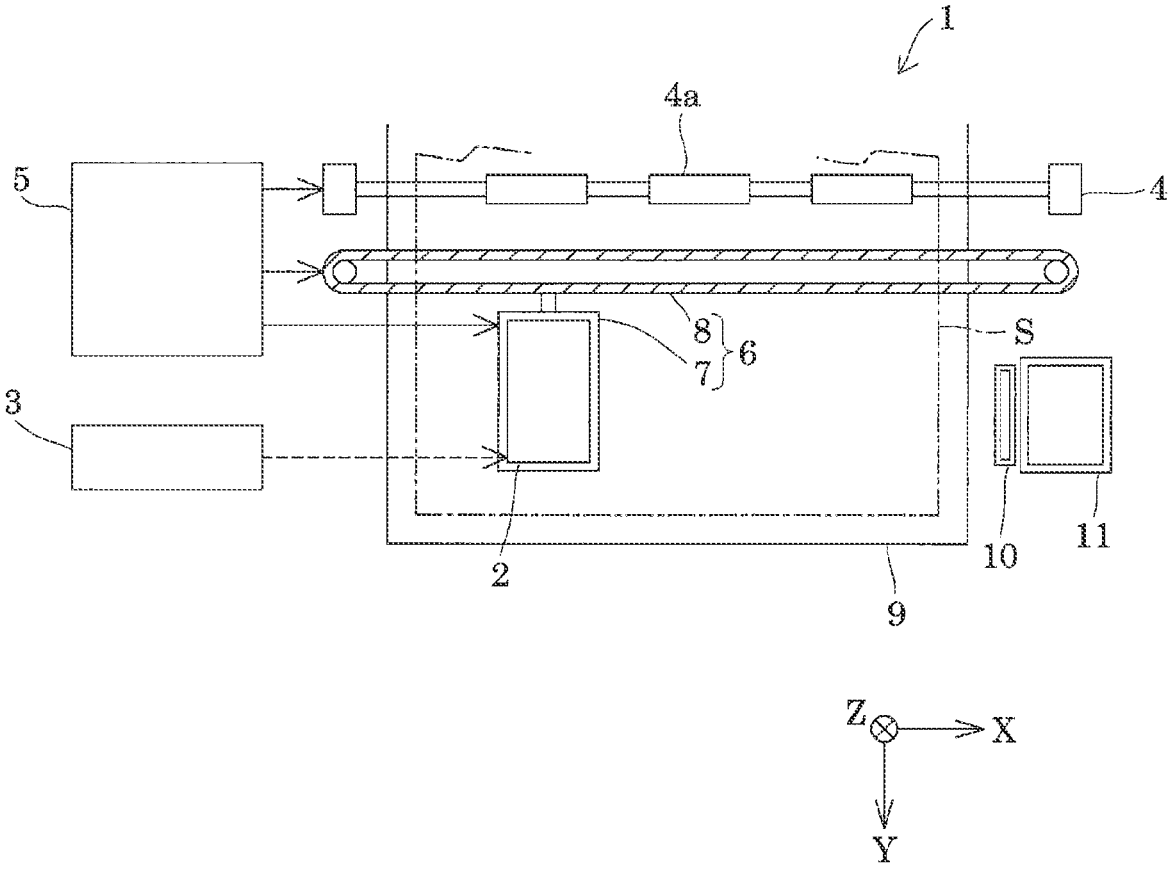
FIG. 1 is a diagram schematically illustrating a schematic configuration of a recording apparatus.

Hereinafter, the present disclosure will be described in detail based on the embodiments. However, the following description illustrates one aspect of the present disclosure, and can be optionally changed within the scope of the present disclosure. The components having the same reference numerals in each figure indicate the same members, and the description thereof is omitted as appropriate. Also, in each figure, X, Y, and Z represent three spatial axes that are orthogonal to each other. In the present specification, directions along these spatial axes are defined as an X direction, a Y direction, and a Z direction. In the description, a direction in which an arrow in each figure is directed is defined as a positive (+) direction, and an opposite direction of the arrow is defined as a negative (−) direction. Further, the Z direction indicates a vertical direction, a +Z direction indicates a vertically downward direction, and a −Z direction indicates a vertically upward direction.

First Embodiment

FIG. 1 is a diagram schematically illustrating an ink jet type recording apparatus which is an example of a liquid ejecting apparatus according to a first embodiment of the present disclosure.

As illustrated in FIG. 1, an ink jet type recording apparatus 1, which is an example of the liquid ejecting apparatus, is a printing apparatus that ejects and lands an ink, which is one type of a liquid, as ink droplets on a printing medium S such as printing paper, and prints an image by the arrangement of dots formed on the printing medium S. Note that as the printing medium S, any material such as a resin film or cloth can be used in addition to the printing paper.

In the following, among the three spatial axes of X, Y, and Z, a moving direction (stated another way, a main scanning direction) of an ejection section 2, which will be described below, is defined as an X axis, a transport direction of the printing medium S orthogonal to the main scanning direction is defined as a Y axis, a surface parallel to a nozzle surface on which a nozzle 35 of the ejection section 2 is formed is defined as an XY plane, a direction intersecting (in the present embodiment, orthogonal to) the nozzle surface, that is, the XY plane is defined as a Z axis, and the ink droplets are ejected in the +Z direction along the Z axis.

The ink jet type recording apparatus 1 includes the ejection section 2 that ejects the ink as the liquid, a liquid container 3, a transport mechanism 4 that transports the printing medium S, a control unit 5 as a control section, a moving mechanism 6, and a support base 9.

The liquid container 3 individually stores a plurality of types (for example, a plurality of colors) of inks ejected from the ejection section 2. Examples of the liquid container 3 include a cartridge that can be attached to and detached from the ink jet type recording apparatus 1, a bag-shaped ink pack made of a flexible film, an ink tank that can be refilled with the ink, and the like. Further, although not particularly illustrated, the plurality of types of inks having different colors and types are stored in the liquid container 3.

Although not particularly illustrated, the control unit 5 includes, for example, a control device such as a central processing unit (CPU) or a field programmable gate array (FPGA), and a storage device such as a semiconductor memory. The control unit 5 totally controls the elements of the ink jet type recording apparatus 1, that is, the ejection section 2, the transport mechanism 4, the moving mechanism 6, and the like by executing the program stored in the storage device by the control device.

The transport mechanism 4 is controlled by the control unit 5 to transport the printing medium S in a +Y direction, and has, for example, a transport roller 4*a*. Note that the transport mechanism 4 that transports the printing medium S may transport the printing medium S by a belt or a drum without being limited to the transport roller 4*a*.

The support base 9 supports a back surface side of the printing medium S on which the ink droplets ejected from the ejection section 2 land on a front surface side thereof. Note that in the present embodiment, the support base 9 that supports the back surface side of the printing medium S is provided, but the present disclosure is not particularly limited to this, and the back surface side of the printing medium S may be supported by a transport belt such as an endless belt.

The moving mechanism 6 is controlled by the control unit 5 to reciprocate the ejection section 2 in a +X direction and a −X direction along the X axis. The +X direction and the −X direction along the X axis in which the ejection section 2 reciprocates by the moving mechanism 6 are directions that intersect the +Y direction in which the printing medium S is transported.

Specifically, the moving mechanism 6 of the present embodiment includes a transport body 7 and a transport belt 8. The transport body 7 is a substantially box-shaped structure that accommodates the ejection section 2, a so-called carriage, and is fixed to the transport belt 8. The transport belt 8 is the endless belt laid in the ±X directions. As the transport belt 8 rotates under the control of the control unit 5, the ejection section 2 reciprocally moves together with the transport body 7 along the X axis along a guide rail (not illustrated). Note that FIG. 1 illustrates a configuration in which one ejection section 2 is installed on the transport body 7 as an example, but the present disclosure is not particularly limited to this, and a plurality of the ejection sections 2 may be installed on the transport body 7. Also, the liquid container 3 can be installed on the transport body 7 together with the ejection section 2.

In a region on one side of the +X direction and the −X direction, which are the main scanning direction of the ejection section 2, in the present embodiment, in a region on the +X direction side, a wiper 10 is disposed as a wiping member that wipes the nozzle surface (described below) on which a nozzle 35 of the ejection section 2 is formed. The wiper 10 of the present embodiment is formed of, for example, a plate-shaped member having elasticity and flexibility such as rubber and an elastomer. In wiping processing, the wiper 10 and the nozzle surface relatively move in a state in which a tip portion of the wiper 10 comes into contact with the nozzle surface, so that the wiper 10 wipes the nozzle surface. Note that the wiping member that wipes the nozzle surface is not limited to the wiper 10, and various well-known components such as a porous material such as a sponge and cloth such as a woven fabric, a knitted fabric, and a non-woven fabric can be adopted.

Further, a cap 11 is disposed adjacent to the wiper 10 on the +X direction side, which is a home position which is a standby position of the transport body 7. The cap 11 is formed in a tray shape that can come into contact with the nozzle surface of the ejection section 2. A space inside the cap 11 functions as a sealed space portion, and the cap 11 is configured to closely come into contact with the nozzle surface in a state in which the nozzle 35, which will be described below, of the ejection section 2 faces to the sealed space portion. Further, a pump is coupled to the cap 11 via a waste liquid tube (not illustrated), and the inside of the sealed space portion of the cap 11 can be negatively pressured by driving the pump.

Maintenance of the ejection section 2 is performed by the wiper 10 and the cap 11. That is, in the present embodiment, the wiper 10 and the cap 11 are "maintenance sections" that perform maintenance processing of discharging the ink as the liquid in the ejection section. After the processing of discharging the ink in the ejection section 2 to the outside by the cap 11, the nozzle surface is wiped by the wiper 10.

Figure 2:
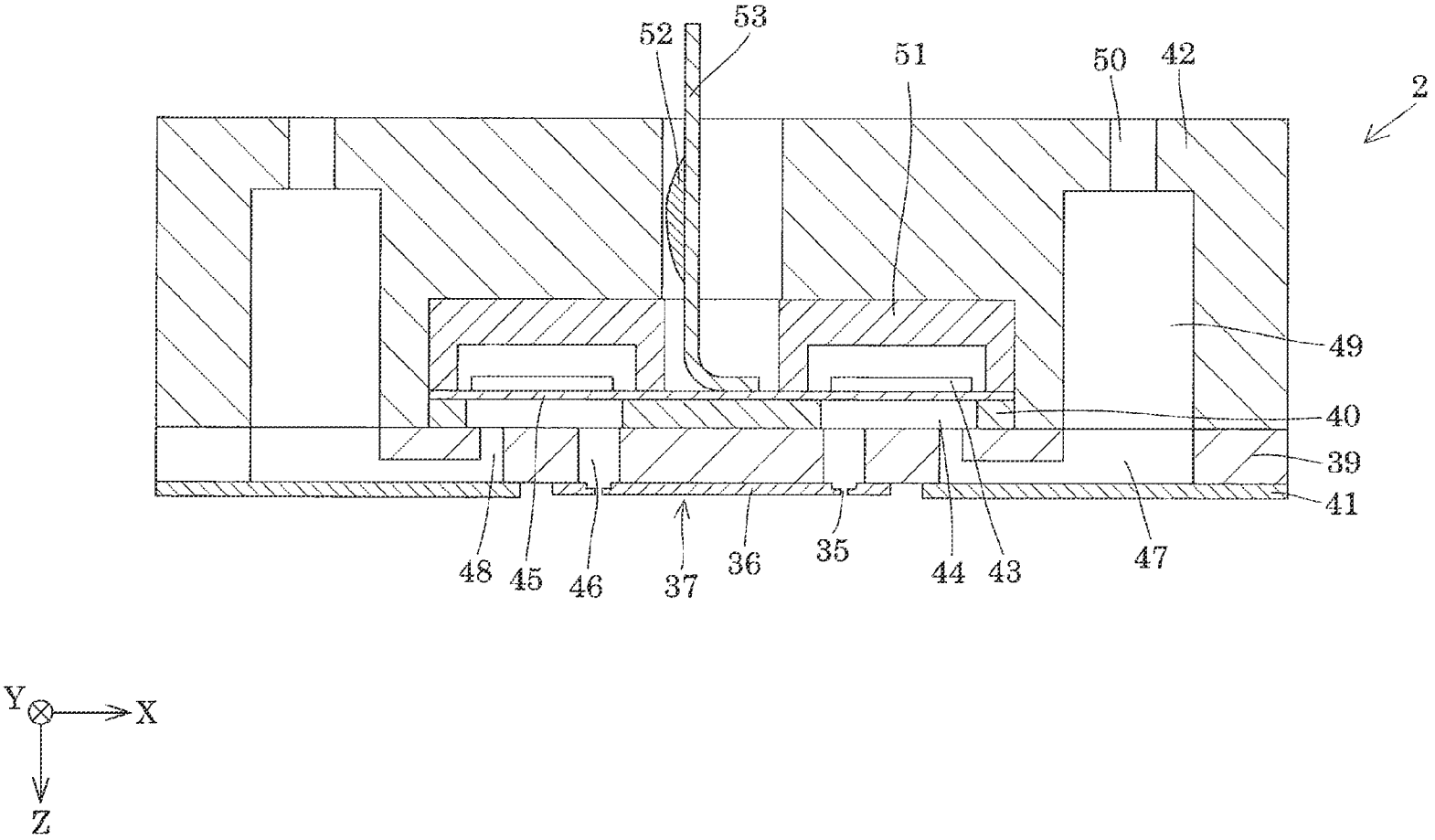
FIG. 2 is a sectional view of an ejection section.

Here, the ejection section 2 of the present embodiment will be further described with reference to FIG. 2. Note that FIG. 2 is a sectional view describing an example of the ejection section 2.

In the ejection section 2 of the present embodiment, a plurality of component members such as a nozzle plate 36, a communication plate 39, a pressure chamber forming substrate 40, a vibrating plate 45, a compliance substrate 41, a piezoelectric actuator 43, a protective substrate 51, and a holder 42 are laminated and unitized by bonding with an adhesive or the like.

The pressure chamber forming substrate 40 in the present embodiment has a plurality of pressure chambers 44 that respectively communicate with a plurality of the nozzles 35 formed on the nozzle plate 36. A plurality of the piezoelectric actuators 43 are provided each corresponding to the pressure chambers 44. The piezoelectric actuator 43 is also called a piezoelectric element, and is a drive element in which a piezoelectric body is interposed between electrodes facing each other. The piezoelectric actuator 43 deforms based on a drive signal to cause the vibrating plate 45 to vibrate, and changes a pressure of the ink in the pressure chamber 44. The vibrating plate 45 is provided between the pressure chamber 44 and the piezoelectric actuator 43, and the vibrating plate 45 seals an opening of the pressure chamber 44 on the −Z direction side to partition a part of the pressure chamber 44. Note that the pressure chamber forming substrate 40 and the vibrating plate 45 may be integrally formed. Then, the piezoelectric actuator 43 is laminated in a region corresponding to each pressure chamber 44 on the vibrating plate 45. The piezoelectric actuator 43 of the present embodiment is formed by, for example, laminating a first electrode, a piezoelectric layer, and a second electrode (which are not illustrated) on the vibrating plate 45 in the order. The piezoelectric actuator 43 configured as described above bends and deforms when an electric field corresponding to a potential difference between the first electrode and the second electrode is applied between both electrodes. Note that any one of the first electrode and the second electrode forms an individual electrode provided for each piezoelectric actuator 43, and the other forms a common electrode common to the plurality of piezoelectric actuators 43.

Further, a wiring substrate 53, which is a flexible substrate on which a drive circuit 52 that drives the piezoelectric actuator 43 is mounted, is coupled to the piezoelectric actuator 43. In the present embodiment, although not particularly illustrated, a lead-out wiring coupled to each electrode of the piezoelectric actuator 43 is led out to a surface of the pressure chamber forming substrate 40, and the wiring substrate 53 is electrically coupled to the lead-out wiring. Note that the drive circuit 52 may be mounted inside the ejection section 2, and the drive circuit 52 and the piezoelectric actuator 43 may be coupled to each other by a bonding wire or a film-formed wiring without being limited to the wiring substrate 53.

The protective substrate 51 is fixed to a surface of the pressure chamber forming substrate 40 on the −Z direction side to protect the plurality of piezoelectric actuators 43.

The communication plate 39 having a larger area than the pressure chamber forming substrate 40 in a plan view in the +Z direction is bonded to a surface of the pressure chamber forming substrate 40 on the +Z direction side. The communication plate 39 of the present embodiment is provided with a nozzle communication port 46 that communicates the pressure chamber 44 with the nozzle 35, a common liquid chamber 47 that is commonly provided in each pressure chamber 44, and an individual communication port 48 that communicates the common liquid chamber 47 with the pressure chamber 44. The common liquid chamber 47 is a space extending along the ±Y directions in which the nozzles 35 are arranged. In the present embodiment, two common liquid chambers 47 are formed corresponding to the rows of two nozzles 35 provided on the nozzle plate 36, respectively. A plurality of the individual communication ports 48 are respectively formed corresponding to each pressure chamber 44 along the ±Y directions, which are nozzle row direction. The individual communication port 48 communicates with an end portion of the pressure chamber 44 on the side opposite to a portion communicating with the nozzle communication port 46.

The nozzle plate 36 on which the plurality of nozzles 35 are formed is bonded to a substantially center portion of a surface of the communication plate 39 on the +Z direction side. The nozzle plate 36 in the present embodiment is a plate material having a smaller outer shape than the communication plate 39 in a plan view in the +Z direction. The nozzle plate 36 is bonded to a position deviated from an opening of the common liquid chamber 47 on the surface of the communication plate 39 on the +Z direction side, that is, a region in which the nozzle communication port 46 is open, by the adhesive in a state in which the nozzle communication port 46 communicates with the plurality of nozzles 35. The nozzle plate 36 in the present embodiment is formed with a total of two nozzle rows in which the plurality of nozzles 35 are arranged along the Y axis. A surface of the nozzle plate 36 on the +Z direction side is the nozzle surface 37.

Further, the compliance substrate 41 is bonded to the surface of the communication plate 39 on the +Z direction side at a position deviated from the nozzle plate 36. The compliance substrate 41 seals the opening of the common liquid chamber 47 on the surface of the communication plate 39 on the +Z direction side in a state of being positioned and bonded to the surface of the communication plate 39 on the +Z direction side. The compliance substrate 41 has a function of relaxing a pressure fluctuation in an ink flow path, particularly in the common liquid chamber 47, by flexibly deformation.

The pressure chamber forming substrate 40, the protective substrate 51, and the communication plate 39 are fixed to the holder 42. Introduction liquid chambers 49 that communicate with the common liquid chamber 47 of the communication plate 39 are formed in the holder 42 on both sides with the pressure chamber forming substrate 40 interposed therebetween. Note that in the present embodiment, the introduction liquid chamber 49 of the holder 42 and the common liquid chamber 47 of the communication plate 39 are collectively referred to as a manifold.

Further, introduction ports 50 that communicate with the introduction liquid chambers 49 are open on a surface of the holder 42 on the −Z direction side. The introduction port 50 communicates with the liquid container 3 via a flow path member or the like having a valve mechanism (not illustrated), and the ink transported from the liquid container 3 is introduced into the introduction port 50, the introduction liquid chamber 49, and the common liquid chamber 47 and supplied to each pressure chamber 44 from the common liquid chamber 47 via the individual communication port 48.

In such an ejection section 2, the piezoelectric actuator 43 is driven in a state in which the inside of a flow path including the introduction liquid chamber 49, the common liquid chamber 47, the pressure chamber 44, and the nozzle 35 is filled with the ink, so that the pressure fluctuation is generated in the ink in the pressure chamber 44 and the ink is ejected from a predetermined nozzle 35 by the pressure fluctuation.

Further, the ink jet type recording apparatus 1 includes the control unit 5. Here, an electrical configuration of the present embodiment will be described with reference to FIG. 3. Note that FIG. 3 is a block diagram illustrating the electrical configuration of the ink jet type recording apparatus 1 according to the first embodiment of the present disclosure.

Figure 3:
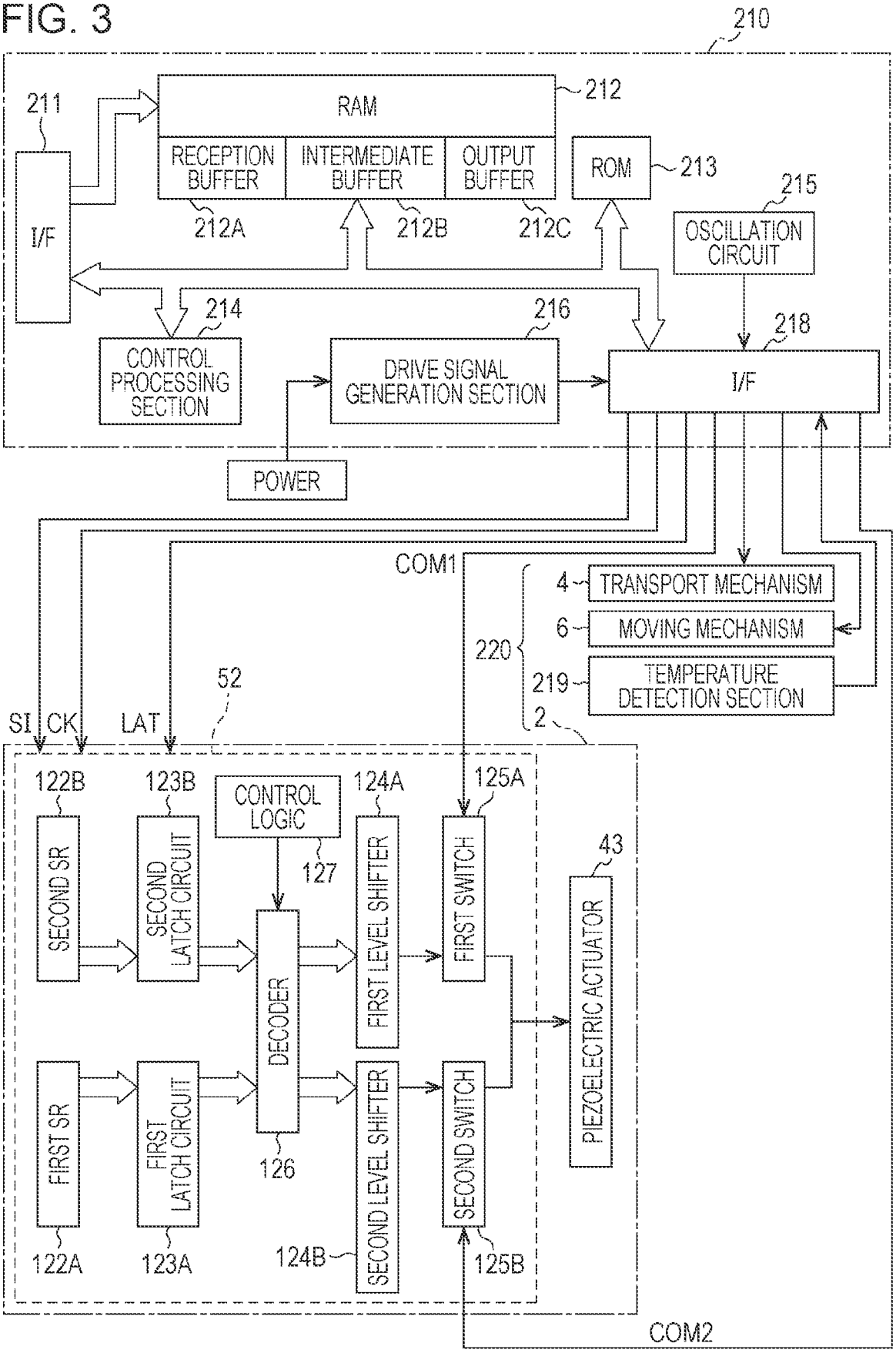
FIG. 3 is a block diagram illustrating an electrical configuration of the recording apparatus.

As illustrated in FIG. 3, the ink jet type recording apparatus 1 includes a printer controller 210, which is the control section, and a print engine 220.

The printer controller 210 is an element that controls the entire ink jet type recording apparatus 1, and is provided in the control unit 5 provided in the ink jet type recording apparatus 1 in the present embodiment. The printer controller 210 corresponds to the "control section" described in the claims.

The printer controller 210 includes an external interface 211 (hereinafter referred to as an external I/F 211), a RAM 212 that temporarily stores various data, a ROM 213 that stores a control program and the like, and a control processing section 214 that includes a CPU and the like. Further, the printer controller 210 includes an oscillation circuit 215 that generates a clock signal, a drive signal generation section 216 that generates the drive signal to be supplied to the ejection section 2, and an internal interface 218 (hereinafter referred to as an internal I/F 218) that transmits dot pattern data (also referred to as bitmap data), which is developed based on the drive signal or printing data, to the print engine 220.

The external I/F 211 receives, for example, the printing data including a character code, a graphic function, image data, and the like from an external apparatus such as a host computer. Further, a busy signal (BUSY) and an acknowledge signal (ACK) are output to the external apparatus via the external I/F 211.

The RAM 212 functions as a reception buffer 212A, an intermediate buffer 212B, an output buffer 212C, and a work memory (not illustrated). Then, the reception buffer 212A temporarily stores the printing data received by the external I/F 211, the intermediate buffer 212B stores intermediate code data converted by the control processing section 214, and the output buffer 212C stores the dot pattern data. Note that the dot pattern data includes print data obtained by decoding (translating) gradation data.

Further, the ROM 213 stores font data, graphic function, and the like in addition to the control program (control routine) for performing various data processing.

The control processing section 214 reads the printing data in the reception buffer 212A, and stores the intermediate code data obtained by converting the printing data in the intermediate buffer 212B. Further, the control processing section 214 analyzes the intermediate code data read from the intermediate buffer 212B, and develops the intermediate code data into the dot pattern data by referring to the font data and the graphic function stored in the ROM 213. Then, the control processing section 214 stores the developed dot pattern data in the output buffer 212C after performing necessary decoration processing.

Then, when the dot pattern data for one line is obtained in the ejection section 2, the dot pattern data for one line is output to the ejection section 2 via the internal I/F 218. Further, when the dot pattern data for one line is output from the output buffer 212C, the developed intermediate code data is deleted from the intermediate buffer 212B, and the next intermediate code data is subjected to developing processing.

The drive signal generation section 216 generates a first drive signal COM1 and a second drive signal COM2. Here, the first drive signal COM1 and the second drive signal COM2 are indicated by a drive waveform, and are also referred to as a first drive waveform COM1 and a second drive waveform COM2. Further, the drive signal generation section 216 generates the drive signal indicated by the drive waveform, and corresponds to a drive waveform generation section that generates the drive waveform.

The first drive signal COM1, which will be described in detail below, includes a non-ejection vibration pulse NP1 that drives the piezoelectric actuator such that the ink droplets are not ejected from the nozzle 35.

The second drive signal COM2, which will be described in detail below, includes an ejection vibration pulse DP that drives the piezoelectric actuator 43 such that the ink droplets are ejected from the nozzle 35, and an in-printing non-ejection vibration pulse NP2 that drives the piezoelectric actuator 43 such that the ink droplets are not ejected from the nozzle 35.

The first drive signal COM1 and the second drive signal COM2 generated by the drive signal generation section 216 are selectively supplied to one electrode, which is the individual electrode of the piezoelectric actuator 43.

The print engine 220 includes the ejection section 2, the transport mechanism 4, the moving mechanism 6, and a temperature detection section 219.

The ejection section 2 includes the drive circuit 52 having a shift register circuit, a latch circuit, a decoder, a control logic, a level shifter circuit, and a switch circuit, and the piezoelectric actuator 43.

The shift register circuit includes a first shift register 122A and a second shift register 122B.

The latch circuit includes a first latch circuit 123A and a second latch circuit 123B.

The level shifter circuit includes a first level shifter 124A and a second level shifter 124B.

The switch circuit includes a first switch 125A and a second switch 125B.

Although not particularly illustrated, the shift registers 122A and 122B, the latch circuits 123A and 123B, the level shifters 124A and 124B, and the switches 125A and 125B include, respectively, shift register elements, latch elements, level shifter elements, and switch elements, which are provided for each nozzle 35 of the ejection section 2. The shift registers 122A and 122B, the latch circuits 123A and 123B, the level shifters 124A and 124B, the switches 125A and 125B, and the piezoelectric actuator 43 are electrically coupled to in this order.

The ejection section 2 drives the piezoelectric actuator 43 based on recorded data (SI) from the printer controller 210. In the present embodiment, a high-order bit group of the recorded data and a low-order bit group of the recorded data are transported to the ejection section 2 in this order, so that the high-order bit group of the recorded data is first set in the second shift register 122B. When the high-order bit group of the recorded data is set in the second shift register 122B for all the nozzles 35, this high-order bit group is shifted to the first shift register 122A. At the same time, the low-order bit group of the recorded data is set in the second shift register 122B.

The first latch circuit 123A is electrically coupled to a rear stage of the first shift register 122A, and the second latch circuit 123B is electrically coupled to a rear stage of the second shift register 122B. Then, when latch signals (LAT) from the printer controller 210 are input to the latch circuits 123A and 123B, the first latch circuit 123A latches the high-order bit group of the recorded data, and the second latch circuit 123B latches the low-order bit group of the recorded data. The recorded data (high-order bit group and low-order bit group) latched by the latch circuits 123A and 123B is output to a decoder 126. The decoder 126 generates pulse selection data for selecting the non-ejection vibration pulse NP1 included in the first drive signal COM1, and the ejection vibration pulse DP and the in-printing non-ejection vibration pulse NP2 included in the second drive signal COM2, based on the high-order bit group and the low-order bit group of the recorded data.

The pulse selection data is generated for each of the first drive signal COM1 and the second drive signal COM2. That is, first pulse selection data corresponding to the first drive signal COM1 is formed by 1-bit data. Also, second pulse selection data corresponding to the second drive signal COM2 is formed by 1-bit data.

Also, a timing signal from a control logic 127 is also input to the decoder 126. The control logic 127 generates the timing signal in synchronization with the input of the latch signal or a channel signal. The timing signal is also generated for each of the first drive signal COM1 and the second drive signal COM2. Each pulse selection data generated by the decoder 126 is sequentially input to the level shifters 124A and 124B from the high-order bit side at a timing defined by the timing signal. The level shifters 124A and 124B function as voltage amplifiers, and when the pulse selection data is "1", outputs voltage values that can be driven by the corresponding switches 125A and 125B, for example, an electric signal boosted to several tens of volts. That is, when the first pulse selection data is "1", the electric signal is output to the first switch 125A, and when the second pulse selection data is "1", the electric signal is output to the second switch 125B, so that the level shifter and the switch is in a coupled state.

The first drive signal COM1 from the drive signal generation section 216 is supplied to the input side of the first switch 125A, and the second drive signal COM2 from the drive signal generation section 216 is supplied to the input side of the second switch 125B. Further, the piezoelectric actuator 43 is electrically coupled to the output side of each of the switches 125A and 125B. The first switch 125A and the second switch 125B are provided for each type of drive signal to be generated, and are interposed between the drive signal generation section 216 and the piezoelectric actuator 43 to selectively supply the first drive signal COM1 and the second drive signal COM2 to the piezoelectric actuator 43. Note that when both the first switch 125A and the second switch 125B are in a non-coupled state, the first drive signal COM1 and the second drive signal COM2 are not supplied to the piezoelectric actuator 43.

The pulse selection data controls the operation of each of the switches 125A and 125B. That is, in a period during which the pulse selection data input to the first switch 125A is "1", it is a conduction state in which the first switch 125A is coupled, and the first drive signal COM1 is supplied to the piezoelectric actuator 43. Similarly, in a period during which the pulse selection data input to the second switch 125B is "1", it is a conduction state in which the second switch 125B is coupled, and the second drive signal COM2 is supplied to the piezoelectric actuator 43. Then, the drive signal applied to the piezoelectric actuator 43 in accordance with the supplied first drive signal COM1 and second drive signal COM2, a so-called applied pulse, changes. On the other hand, in a period during which pieces of the pulse selection data input to the switches 125A and 125B are all "0", the switches 125A and 125B are in the non-coupled state, the first drive signal COM1 and the second drive signal COM2 are not supplied to the piezoelectric actuator 43. In short, the pulse in the period during which "1" is set as the pulse selection data is selectively supplied to the piezoelectric actuator 43. Note that in the period during which both pieces of the pulse selection data are "0", the piezoelectric actuator 43 holds the immediately preceding potential, so that an immediately preceding displacement state is maintained.

As described above, in the present embodiment, the decoder 126, the control logic 127, the level shifters 124A and 124B, and the switches 125A and 125B function as the "selection section" which supplies any one of the first drive signal COM1 and the second drive signal COM2 or does not supply both the first drive signal COM1 and the second drive signal COM2 to the piezoelectric actuator 43.

Note that the printer controller 210 controls the supply of the non-ejection vibration pulse NP1 of the first drive signal COM1 and the in-printing non-ejection vibration pulse NP2 of the second drive signal COM2 to the piezoelectric actuator 43, in accordance with a temperature of the ink in the pressure chamber 44 detected by the temperature detection section 219. Here, as the temperature of the ink in the pressure chamber 44 detected by the temperature detection section 219, the temperature of the ink in the pressure chamber may be directly detected or the temperature of the ink in the pressure chamber 44 may be estimated. For example, the temperature detection section 219 which detects the temperature of the ink in the pressure chamber 44 or the temperature of the ink in the flow path communicating with the pressure chamber, such as the manifold, may be provided, and a result of detection by the temperature detection section 219 may be the temperature of the ink in the pressure chamber 44. Further, as the temperature detection section 219, various well-known configurations provided to come into contact with the ejection section 2 can be adopted. That is, the temperature detection section 219 may be provided on, for example, the wiring substrate 53, the protective substrate 51, the holder 42, the compliance substrate 41, and the like and estimate the temperature of the ink in the pressure chamber 44 from the results of detection by these components. Further, the temperature detection section 219 may be provided in the ink jet type recording apparatus 1 and estimate the temperature of the ink in the pressure chamber 44 from the result of detection by the temperature detection section 219 provided in the ink jet type recording apparatus 1. Also, the temperature of the ink droplets ejected from the nozzle 35 may be detected by the temperature detection section 219, and the result of detection may be used as the temperature of the ink in the pressure chamber 44.

The temperature detection section 219 detects the temperature, and for example, a contact-type temperature sensor such as a thermoelectric resistor, a thermocouple, or a thermistor can be used.

Figure 4:
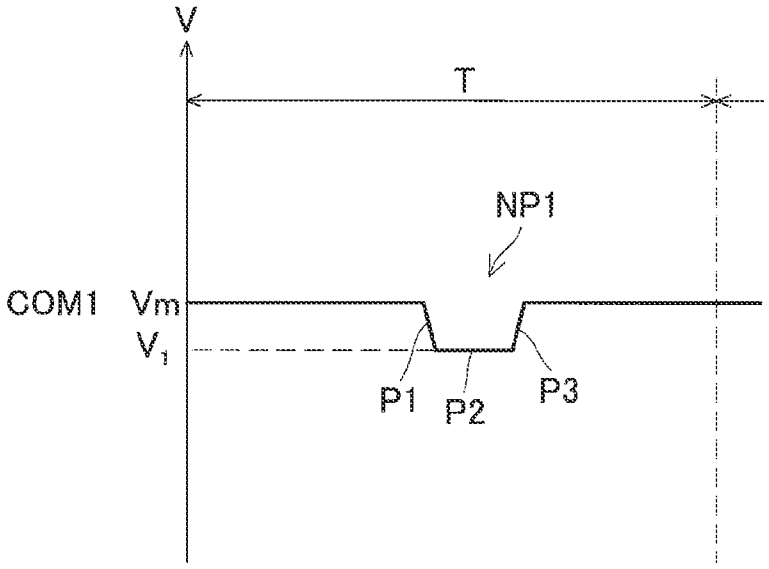
FIG. 4 illustrates a drive waveform indicating a first drive signal.
Figure 5:
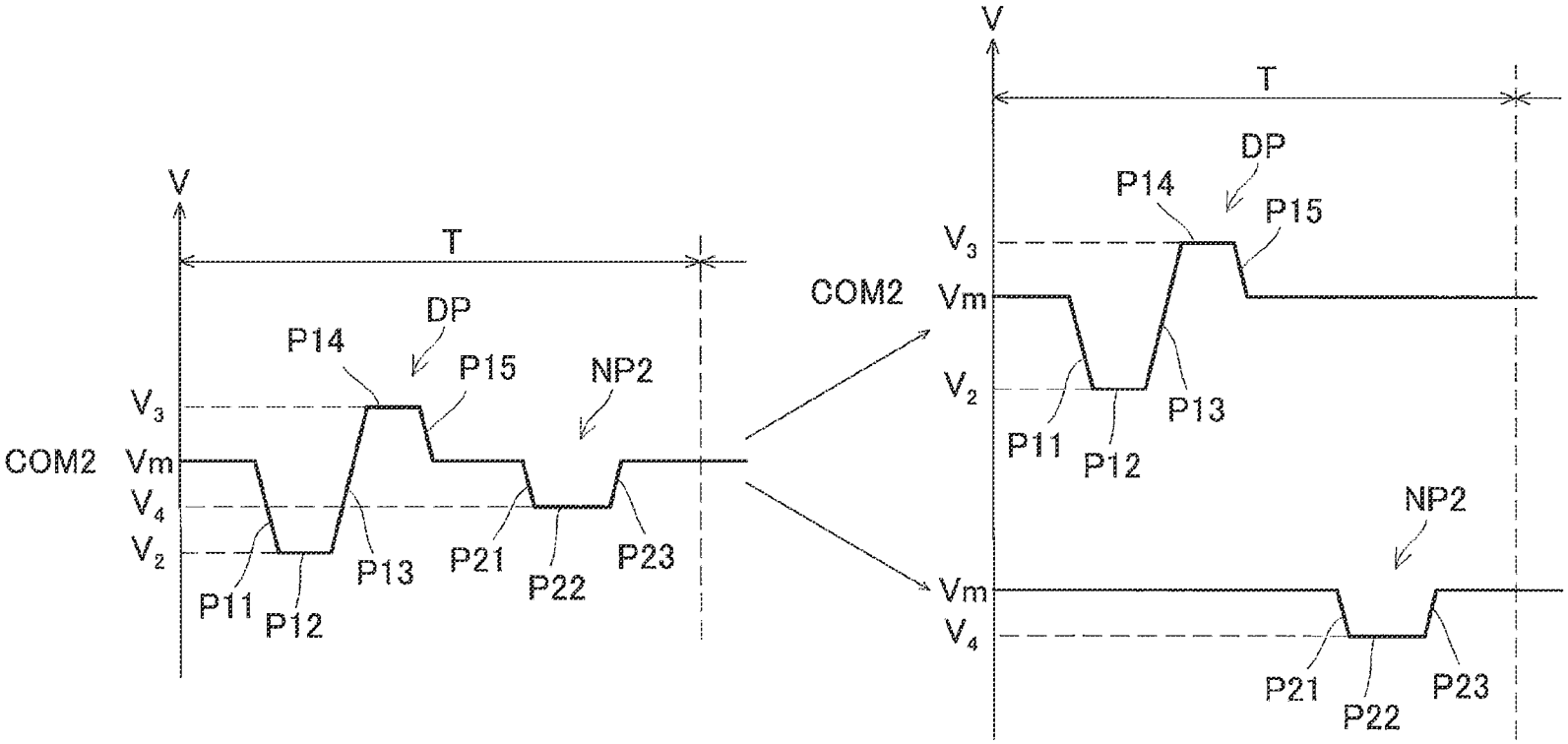
FIG. 5 illustrates a drive waveform indicating a second drive signal.

Hereinafter, the first drive signal COM1 and the second drive signal COM2 generated by the drive signal generation section 216, and the supply control of the first drive signal COM1 and the second drive signal COM2 to the piezoelectric actuator 43 will be described. FIG. 4 illustrates the drive waveform indicating the first drive signal COM1. FIG. 5 illustrates the drive waveform indicating the second drive signal COM2.

As illustrated in FIG. 4, the first drive signal COM1 is repeatedly generated from the drive signal generation section 216 for each unit cycle T defined by the clock signal transmitted from the oscillation circuit 215. The unit cycle T is also referred to as an ejection cycle T or a recording cycle T, and corresponds to one pixel of the image or the like to be printed on the printing medium S. In the present embodiment, the first drive signal COM1 is a signal having the non-ejection vibration pulse NP1 that drives the piezoelectric actuator 43 such that the ink droplets are not ejected from the nozzle 35 within one recording cycle T, and is repeatedly generated for each recording cycle T.

The non-ejection vibration pulse NP1 is a drive waveform that vibrates the piezoelectric actuator 43 such that the ink droplets are not ejected from the nozzle 35, and is a trapezoidal wave in the present embodiment. Specifically, the non-ejection vibration pulse NP1 includes a first non-ejection expansion element P1 that expands a volume of the pressure chamber 44 from a reference volume by applying a potential from an intermediate potential Vm to a first potential $V_1$, a first non-ejection expansion maintaining element P2 that maintains the volume of the pressure chamber 44 expanded by the first non-ejection expansion element P1 for a certain period of time, and a first non-ejection restoring element P3 that restores the pressure chamber 44 from the expanded state of the first potential $V_1$ to the reference volume of the intermediate potential Vm.

When such a non-ejection vibration pulse NP1 is supplied to the piezoelectric actuator 43, the piezoelectric actuator 43 performs non-ejection vibration, so-called micro-vibration, such that the ink droplets are not ejected from the nozzle 35. That is, the first potential $V_1$ of the non-ejection vibration pulse NP1 is set at a potential at which the ink droplets are not ejected from the nozzle 35.

When such a non-ejection vibration pulse NP1 is supplied to the piezoelectric actuator 43 and the piezoelectric actuator 43 performs non-ejection vibration, the piezoelectric actuator 43 generates heat by heat generation due to the vibration of the piezoelectric actuator 43 itself, heat generation due to electric power consumption of the piezoelectric actuator 43, heat generation of the drive circuit 52, and heat generation due to an ink flow, and the like. Therefore, the inside of the ejection section 2 can be heated by causing the piezoelectric actuator 43 to non-ejection vibrate, and the ink flowing into the ejection section 2 can be heated. Further, the ink meniscus in the nozzle surface 37 or the nozzle 35 of the nozzle plate 36 is particularly easy to cool, but the inks inside the pressure chamber 44 and the nozzle 35 are stirred by causing the piezoelectric actuator 43 to non-ejection vibrate by the non-ejection vibration pulse NP1, and thus the variation in the temperature of the ink in the pressure chamber 44 can be suppressed.

The printer controller 210 controls the supply of the non-ejection vibration pulse NP1 to the piezoelectric actuator 43 in accordance with the temperature of the ink in the pressure chamber 44 detected by the temperature detection section 219 in a standby period other than a printing operation period. That is, in the standby period, when the temperature detected by the temperature detection section 219 is lower than a predetermined temperature (also known as a threshold value), the printer controller 210 controls the drive circuit 52 such that the non-ejection vibration pulse NP1 is supplied to the piezoelectric actuator 43. Further, in the standby period, when the temperature detected by the temperature detection section 219 is equal to or higher than the predetermined temperature (also known as the threshold value), the printer controller 210 controls the drive circuit 52 such that the non-ejection vibration pulse NP1 is not supplied to the piezoelectric actuator 43.

As illustrated in FIG. 5, the second drive signal COM2 is repeatedly generated from the drive signal generation section 216 for each unit cycle T defined by the clock signal transmitted from the oscillation circuit 215. The unit cycle T is also referred to as an ejection cycle T or a recording cycle T, and corresponds to one pixel of the image or the like to be printed on the printing medium S. In the present embodiment, the second drive signal COM2 is a signal having the ejection vibration pulse DP that drives the piezoelectric actuator 43 such that the ink droplets are ejected from the nozzle 35, and the in-printing non-ejection vibration pulse NP2 that drives the piezoelectric actuator 43 such that the ink droplets are not ejected from the nozzle 35 within one recording cycle T, and is repeatedly generated for each recording cycle T.

The ejection vibration pulse DP includes a first expansion element P11, a first expansion maintaining element P12, a first contraction element P13, a first contraction maintaining element P14, and a first restoring element P15.

The first expansion element P11 expands the volume of the pressure chamber 44 from the reference volume by applying a potential from the intermediate potential Vm to a second potential $V_2$. The first expansion maintaining element P12 maintains the volume of the pressure chamber 44 expanded by the first expansion element P11 for a certain period of time. The first contraction element P13 contracts the volume of the pressure chamber 44 by applying a potential from the second potential $V_2$ to a third potential $V_3$. The first contraction maintaining element P14 maintains the volume of the pressure chamber 44 contracted by the first contraction element P13 for a certain period of time. The first restoring element P15 restores the pressure chamber 44 from the contracted state of the third potential $V_3$ to the reference volume of the intermediate potential Vm.

When such an ejection vibration pulse DP is supplied to the piezoelectric actuator 43, the piezoelectric actuator 43 deforms in a direction of expanding the volume of the pressure chamber 44 by the first expansion element P11, and the meniscus in the nozzle 35 is drawn to the pressure chamber 44 side, the ink is supplied to the pressure chamber 44 from the common liquid chamber 47 side. Further, the expanded state of the pressure chamber 44 is maintained by the first expansion maintaining element P12. Thereafter, the first contraction element P13 is supplied, the pressure chamber 44 is rapidly contracted from the expansion volume to the contraction volume corresponding to the third potential $V_3$, the ink in the pressure chamber 44 is pressurized, and the ink droplets are ejected from the nozzle 35. The contracted state of the pressure chamber 44 is maintained by the first contraction maintaining element P14, and the ink pressure in the pressure chamber 44 reduced by the ejection of the ink droplets during this period rises again due to its natural vibration. The first restoring element P15 is supplied in accordance with this rise timing, the pressure chamber 44 is restored to the reference volume, and the pressure fluctuation in the pressure chamber 44 is absorbed.

The in-printing non-ejection vibration pulse NP2 is a drive waveform that causes the piezoelectric actuator 43 to vibrate such that the ink droplets are not ejected from the nozzle 35, and is a trapezoidal wave in the present embodiment. Specifically, the in-printing non-ejection vibration pulse NP2 includes a second non-ejection expansion element P21 that expands the volume of the pressure chamber 44 from a reference volume by applying a potential from the intermediate potential Vm to a fourth potential $V_4$, a second non-ejection expansion maintaining element P22 that maintains the volume of the pressure chamber 44 expanded by the second non-ejection expansion element P21 for a certain period of time, and a second non-ejection restoring element P23 that restores the pressure chamber 44 from the expanded state of the fourth potential $V_4$ to the reference volume of the intermediate potential Vm.

When such an in-printing non-ejection vibration pulse NP2 is supplied to the piezoelectric actuator 43, the piezoelectric actuator 43 performs non-ejection vibration, so-called micro-vibration, such that the ink droplets are not ejected from the nozzle 35. That is, the fourth potential $V_4$ of the in-printing non-ejection vibration pulse NP2 is set at a potential at which the ink droplets are not ejected from the nozzle 35. Note that the fourth potential $V_4$ of the in-printing non-ejection vibration pulse NP2 may be the same potential as or a different potential from the first potential $V_1$ of the non-ejection vibration pulse NP1. That is, the non-ejection vibration pulse NP1 and the in-printing non-ejection vibration pulse NP2 may have the same drive waveform or different drive waveforms. Incidentally, the non-ejection vibration pulse NP1 is supplied to the piezoelectric actuator 43 in the standby period other than the printing operation period, and the in-printing non-ejection vibration pulse NP2 is supplied to the piezoelectric actuator 43 in the printing operation period. Therefore, the non-ejection vibration pulse NP1 and the in-printing non-ejection vibration pulse NP2 can be optimized in accordance with the printing operation, respectively.

When such an in-printing non-ejection vibration pulse NP2 is supplied to the piezoelectric actuator 43 and the piezoelectric actuator 43 performs non-ejection vibration, similar to the non-ejection vibration pulse NP1, the piezoelectric actuator 43 generates heat by heat generation due to the vibration of the piezoelectric actuator 43 itself, heat generation due to electric power consumption of the piezoelectric actuator 43, heat generation of the drive circuit 52, and heat generation due to an ink flow, and the like. Therefore, by causing the piezoelectric actuator 43 to non-ejection vibrate by the in-printing non-ejection vibration pulse NP2, the ink in the pressure chamber in the ejection section 2 can be heated and the heated ink can be ejected. Further, the ink meniscus in the nozzle surface 37 or the nozzle 35 of the nozzle plate 36 is particularly easy to cool, but by causing the piezoelectric actuator 43 to non-ejection vibrate by the in-printing non-ejection vibration pulse NP2, the inks inside the pressure chamber 44 and the nozzle 35 are stirred, and thus the variation in the temperature of the ink in the pressure chamber 44 can be suppressed.

The printer controller 210 controls the drive circuit 52 such that any one of the ejection vibration pulse DP and the in-printing non-ejection vibration pulse NP2 of the second drive signal COM2 is selectively supplied to the piezoelectric actuator 43 in the printing operation period during which the image is printed on the printing medium S in accordance with the printing data. That is, in the printer controller 210 controls the drive circuit 52 such that the ejection vibration pulse DP is supplied to the piezoelectric actuator 43 corresponding to the nozzle 35 which ejects the ink droplets for printing the image on the printing medium S in accordance with the printing data within one pixel (also referred to as one cycle) in the printing operation period. Also, in the printer controller 210 controls the drive circuit 52 such that the in-printing non-ejection vibration pulse NP2 is supplied to the piezoelectric actuator 43 corresponding to the nozzle 35 which does not eject the ink droplets in accordance with the printing data within one pixel (also referred to as one cycle) in the printing operation period.

Here, the printing operation period, a non-printing operation period, and the standby period of the present embodiment will be described with reference to FIG. 6. Note that FIG. 6 is a diagram describing a printing region and a non-printing region of the ink jet type recording apparatus 1.

Figure 6:
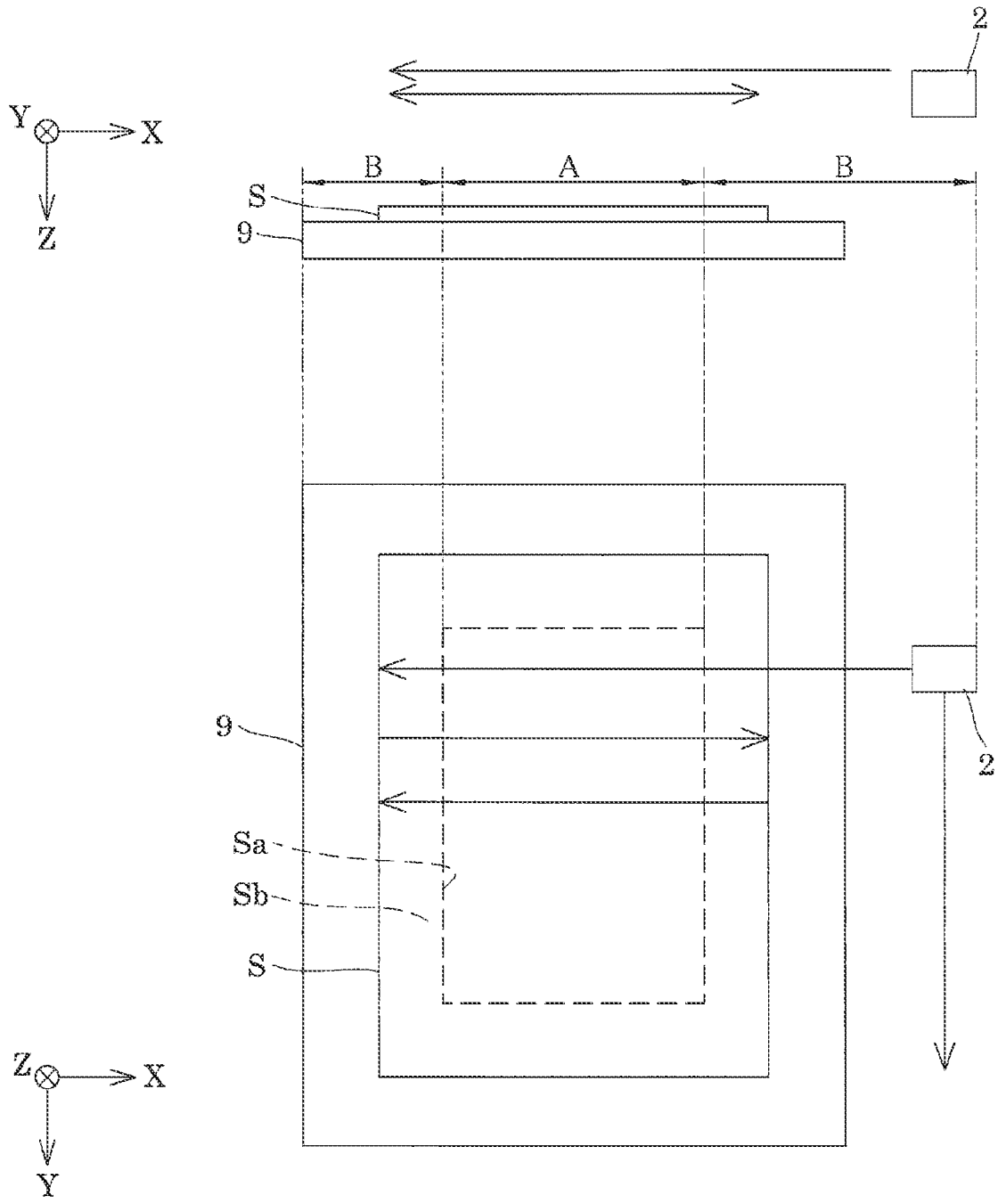
FIG. 6 is a diagram describing a printing region and a non-printing region of the recording apparatus.

As illustrated in FIG. 6, in the printing medium S supported by the support base 9 of the ink jet type recording apparatus 1, a printing range Sa in which printing can be performed is set in a center portion and a non-printing range Sb that printing is not performed is set over the periphery of the printing range Sa.

The ejection section 2 is provided to be reciprocally movable in the +X direction and the −X direction along the X axis with respect to the printing medium S supported by the support base 9. Then, when printing is started, the ejection section 2 starts from the home position and reciprocally moves along the X axis at a position facing the printing medium S on the Z axis to perform printing, and when printing is completed, the ejection section 2 returns to the home position. In this case, a region in which the ejection section 2 faces the printing range Sa of the printing medium S, that is, a position in which the ejection section 2 can land the ink droplets in the printing range Sa is referred to as a printing region A. On the other hand, a position outside the region in which the ejection section 2 faces the printing range Sa of the printing medium S is referred to as a non-printing region B. The non-printing region B includes the non-printing range Sb of the printing medium S, a portion of the support base 9 on which the printing medium S is not placed, and the home position. Note that the home position is a place in which the ejection section 2 other than the printing operation period is stopped and waits for a printing command, from when the power of the ink jet type recording apparatus 1 is turned on to when the power is turned off.

The printing operation period is a period during which the ejection section 2 moves in the printing region A to print the image.

The non-printing operation period is a period during which the ejection section 2 moves in the non-printing region B from a point in time when the ejection section 2 starts moving to a point in time when the ejection section 2 arrives at the home position after the printing is completed.

Further, the standby period is a period during which the ejection section 2 other than the printing operation period is stopped and waits for the printing command, from when the power of the ink jet type recording apparatus 1 is turned on to when the power is turned off.

Then, the printer controller 210 controls the supply of the non-ejection vibration pulse NP1 to the piezoelectric actuator 43 in the standby period other than the printing operation period. Note that in the present embodiment, the printer controller 210 controls the supply of the non-ejection vibration pulse NP1 to the piezoelectric actuator 43 in the non-printing operation period including the standby period.

Further, as described above, the printer controller 210 controls the supply of the non-ejection vibration pulse NP1 to the piezoelectric actuator 43 in accordance with the temperature of the ink in the pressure chamber 44 detected by the temperature detection section 219 in the standby period other than the printing operation period, that is, the non-printing operation period including the standby period in the present embodiment. That is, in the non-printing operation period, when the temperature detected by the temperature detection section 219 is lower than the predetermined temperature (also known as the threshold value), the printer controller 210 controls the drive circuit 52 such that the non-ejection vibration pulse NP1 is supplied to the piezoelectric actuator 43. Further, in the standby period, when the temperature detected by the temperature detection section 219 is equal to or higher than the predetermined temperature (also known as the threshold value), the printer controller 210 controls the drive circuit 52 such that the non-ejection vibration pulse NP1 is not supplied to the piezoelectric actuator 43.

Further, the printer controller 210 controls the supply of the in-printing non-ejection vibration pulse NP2 to the piezoelectric actuator 43 in the printing operation period, that is, in the printing region A.

Also, the printer controller 210 executes the maintenance processing at the optimum timing of the non-printing operation period including the printing operation period or the standby period. The maintenance processing referred to here is processing of discharging the ink in the ejection section 2 to the outside, and refers to a suction operation of sucking the ink in the ejection section 2 from the nozzle 35 by covering the nozzle 35 with the cap 11 to cause the sealed space covered with the cap 11 to be negatively pressured or a so-called flushing of ejecting the ink droplets toward a region other than the printing medium S. Also, it is possible to pressurize the ink in the flow path from the liquid container 3 to the ejection section 2 to discharge the ink in the ejection section 2. Then, after the ink in the ejection section 2 is discharged, the nozzle surface 37 on which the nozzle 35 is open is wiped by the wiper 10 to wipe the ink adhering to the nozzle surface 37. That is, the maintenance processing includes the wiping processing of wiping, by the wiper 10, the nozzle surface 37 on which the nozzle 35 is open. When performing such the wiping processing, when the piezoelectric actuator 43 is caused to non-ejection vibrate by supplying the non-ejection vibration pulse NP1 to the piezoelectric actuator 43, the meniscus of the ink in the nozzle 35 vibrates and the ink in the nozzle 35 comes into contact with the wiper 10, so that the meniscus of the ink is broken. Then, even when an attempt is made to eject the ink droplets in a state in which the meniscus of the ink in the nozzle 35 is broken, so-called nozzle omission in which the ink droplets is not normally ejected may occur. Therefore, the printer controller 210 performs control not to supply the non-ejection vibration pulse NP1 to the piezoelectric actuator 43 during the maintenance processing is performed. As a result, it is possible to suppress the breaking of the meniscus of the ink in the nozzle 35 and suppress the occurrence of so-called nozzle omission in which the ink droplets are not ejected during printing.

Here, a drive method of the ink jet type recording apparatus 1 will be described with reference to FIG. 7. Note that FIG. 7 is an example of a time chart describing the drive method of the ink jet type recording apparatus 1.

Figure 7:
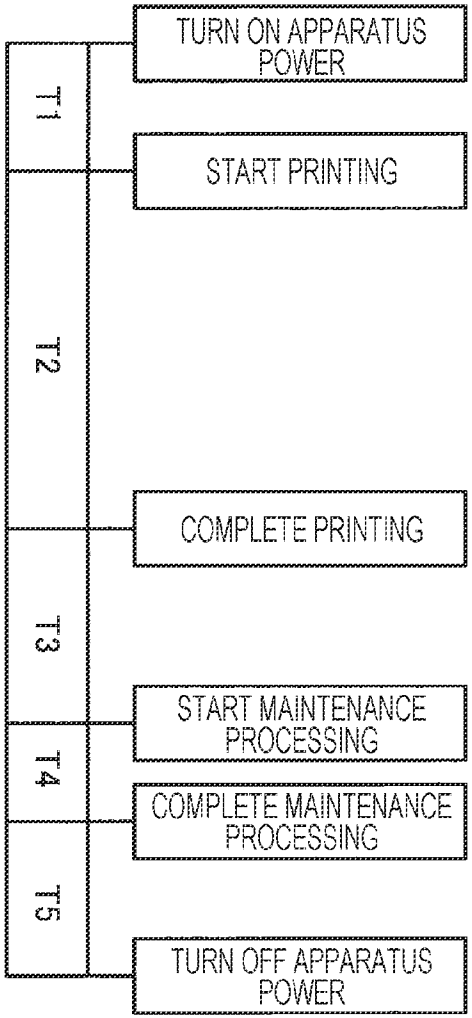
FIG. 7 is a time chart describing a drive method of the recording apparatus.

As illustrated in FIG. 7, a period T1 from when the power of the ink jet type recording apparatus 1 is turned on (ON) to when printing is started is the standby period. In the period T1, the printer controller 210 controls the supply of the non-ejection vibration pulse NP1 to the piezoelectric actuator 43 based on the temperature of the ink in the pressure chamber 44 detected by the temperature detection section 219. That is, the printer controller 210 starts, based on the power-on operation of the ink jet type recording apparatus 1, control of the supply of the non-ejection vibration pulse NP1 corresponding to the temperature of the ink.

A period T2 from when printing is started to when printing is completed includes the printing operation period in which the ejection section 2 is positioned in the printing region A and the non-printing operation period in which the ejection section 2 is positioned in the non-printing region B. In the non-printing operation period of the period T2, the printer controller 210 controls the supply of the non-ejection vibration pulse NP1 to the piezoelectric actuator 43 based on the temperature of the ink in the pressure chamber 44 detected by the temperature detection section 219. Specifically, in the non-printing operation period of the period T2, when the temperature of the ink in the pressure chamber 44 detected by the temperature detection section 219 is lower than the predetermined temperature (also known as the threshold value), the printer controller 210 controls the drive circuit 52 such that the non-ejection vibration pulse NP1 is supplied to the piezoelectric actuator 43. Further, in the non-printing operation period, when the temperature detected by the temperature detection section 219 is equal to or higher than the predetermined temperature (also known as the threshold value), the printer controller 210 controls the drive circuit 52 such that the non-ejection vibration pulse NP1 is not supplied to the piezoelectric actuator 43. Further, in the printing operation period of the period T2, the printer controller 210 controls the drive circuit 52 such that the in-printing non-ejection vibration pulse NP2 is supplied to the piezoelectric actuator 43 corresponding to a non-ejection pixel, that is, the nozzle 35 which does not eject the ink droplets in accordance with the printing data. Further, in the printing operation period of the period T2, the printer controller 210 controls the drive circuit 52 such that the ejection vibration pulse DP is supplied to the piezoelectric actuator 43 corresponding to an ejection pixel, that is, the nozzle 35 which ejects the ink droplets in accordance with the printing data.

A period T3 from when printing is completed to when the maintenance processing is started is the standby period. In the period T3, the printer controller 210 controls the supply of the non-ejection vibration pulse NP1 to the piezoelectric actuator 43 based on the temperature of the ink in the pressure chamber 44 detected by the temperature detection section 219.

In a period T4 from when the maintenance processing is started to when the maintenance processing is completed, the wiper 10 comes into contact with the nozzle surface 37, so that the printer controller 210 controls the drive circuit 52 such that the non-ejection vibration pulse NP1 is not supplied to the piezoelectric actuator 43. That is, even when the temperature of the ink in the pressure chamber 44 detected by the temperature detection section 219 is lower than the predetermined temperature, the printer controller 210 stops the supply of the non-ejection vibration pulse NP1 to the piezoelectric actuator 43 during the maintenance processing is performed.

A period T5 from when the maintenance processing is completed to when the power of the ink jet type recording apparatus 1 is turned off (OFF) is the standby period. In the period T5, the printer controller 210 controls the supply of the non-ejection vibration pulse NP1 to the piezoelectric actuator 43 based on the temperature of the ink in the pressure chamber 44 detected by the temperature detection section 219. That is, the printer controller 210 stops, based on the power-off operation of the ink jet type recording apparatus 1, control of the supply of the non-ejection vibration pulse NP1 corresponding to the temperature of the ink.

Note that in the non-printing operation period of the period T2 in which the ejection section 2 is positioned in the non-printing region B, the printer controller 210 may not supply the non-ejection vibration pulse NP1 to the piezoelectric actuator 43. That is, the printer controller 210 may control the supply of the non-ejection vibration pulse NP1 to the piezoelectric actuator 43 only by the standby period other than the printing operation period. As described above, in the non-printing operation period of the period T2 in which the ejection section 2 is positioned in the non-printing region B, the printer controller 210 may not supply the non-ejection vibration pulse NP1 to the piezoelectric actuator 43, so that breaking of the meniscus of the ink in the nozzle 35 due to contacting of the printing medium S with the nozzle surface 37 in the non-printing operation period of the period T2 can be suppressed. That is, since an end portion of the printing medium S is likely to be lifted due to curling or the like of the printing medium S, the end portion of the printing medium S is likely to come into contact with the nozzle 35 when the ejection section 2 is positioned in the non-printing operation period of the period T2. Then, when the piezoelectric actuator 43 is caused to non-ejection vibrate by supplying the non-ejection vibration pulse NP1 to the piezoelectric actuator 43, the meniscus of the ink in the nozzle 35 vibrates and the ink in the nozzle 35 comes into contact with the printing medium S, so that the meniscus of the ink is broken. Even when an attempt is made to eject the ink droplets in a state in which the meniscus of the nozzle 35 is broken as described above, so-called nozzle omission in which the ink droplets is not normally ejected may occur. In the non-printing operation period of the period T2 during which the printing medium S is likely to come into contact with the nozzle 35, the non-ejection vibration pulse NP1 is not supplied to the piezoelectric actuator 43, so that the breaking of the meniscus of the ink in the nozzle 35 can be suppressed and the occurrence of so-called nozzle omission in which the ink droplets are not ejected during printing can be suppressed. Incidentally, since the non-printing operation period of the period T2 in which the ejection section 2 is positioned in the non-printing region B is a short time, even when the non-ejection vibration pulse NP1 is not supplied during this period, the temperature drop of the ink in the pressure chamber 44 is low and the influence on the ejection characteristics is small. Further, by not supplying the non-ejection vibration pulse NP1 in the non-printing operation period of the period T2 in which the ejection section 2 is positioned in the non-printing region B, a contact object detection section such as a sensor that detects a contact object that may come into contact with the nozzle surface 37 is unnecessary, and control can be facilitated and the cost can be reduced.

Here, a specific example of the drive method of the ink jet type recording apparatus 1 of the present embodiment will be described with reference to FIG. 8. Note that FIG. 8 is a flowchart describing the drive method of the ink jet type recording apparatus 1.

Figure 8:
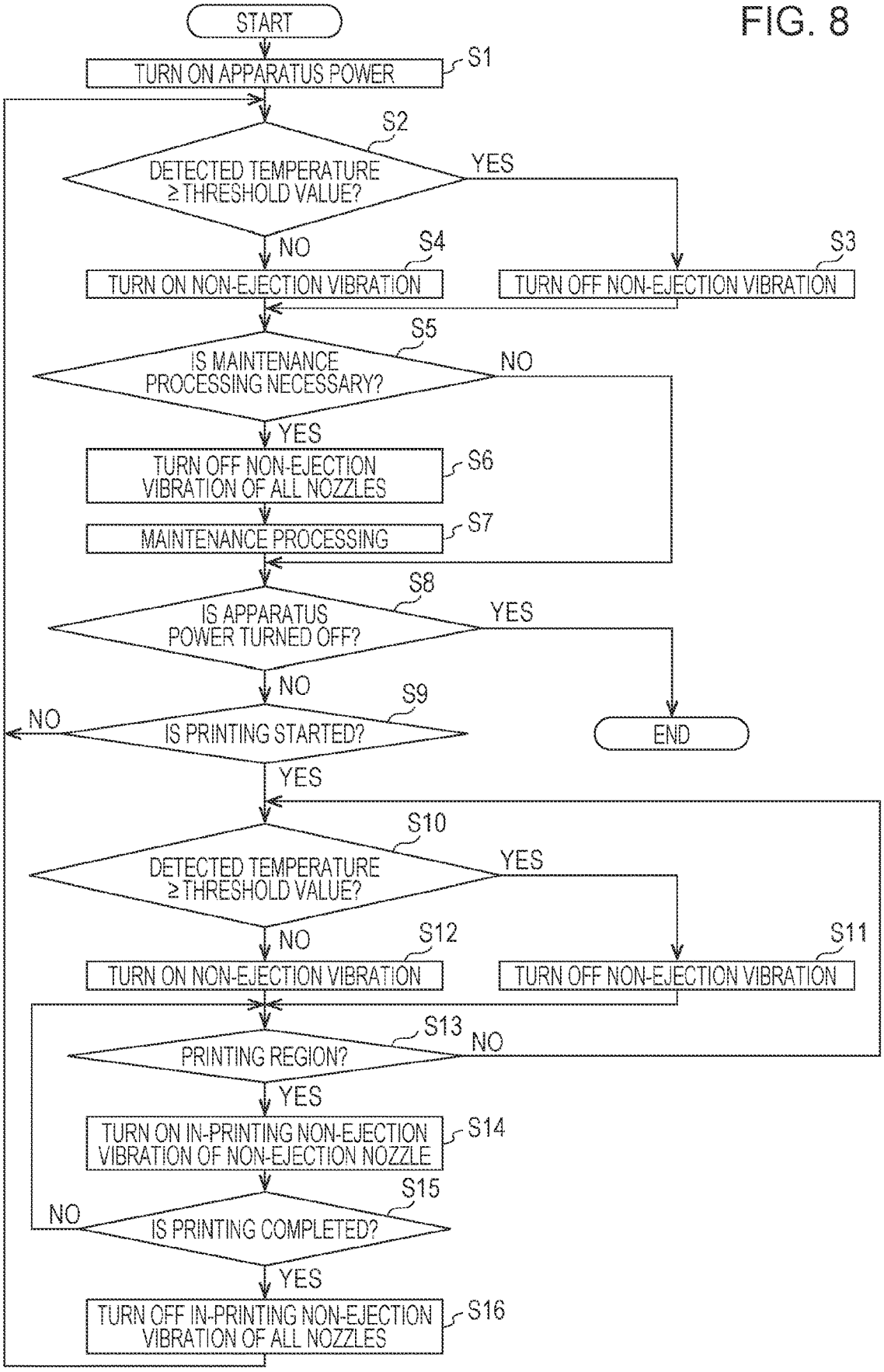
FIG. 8 is a flowchart describing the drive method of the recording apparatus.

As illustrated in FIG. 8, when the power of the ink jet type recording apparatus 1 is turned on (ON) in step S1, the printer controller 210 determines whether the temperature of the ink in the pressure chamber detected by the temperature detection section 219 is equal to or higher than the threshold value in step S2. In step S2, when the temperature of the ink in the pressure chamber detected by the temperature detection section 219 is equal to or higher than the threshold value (step S2: Yes), it is not necessary to heat the ink in the pressure chamber 44, and thus in step S3, the printer controller 210 controls the drive circuit 52 such that the non-ejection vibration pulse NP1 is not supplied to the piezoelectric actuator 43. Therefore, heat generation caused by driving the piezoelectric actuator 43, that is, heating of the ink is not performed.

In step S2, when the temperature of the ink in the pressure chamber 44 detected by the temperature detection section 219 is lower than the predetermined temperature (hereinafter, referred to as the threshold value) (step S2: No), in step S4, the printer controller 210 controls the drive circuit 52 such that the non-ejection vibration pulse NP1 is supplied to the piezoelectric actuator 43. Therefore, the piezoelectric actuator 43 generates heat by non-ejection vibration due to the non-ejection vibration pulse NP1, and the ink inside the ejection section 2 is heated.

Next, in step S5, the printer controller 210 determines whether or not the maintenance processing is necessary. When it is determined in step S5 that the maintenance processing is necessary (step S5: Yes), in step S6, the printer controller 210 performs control to stop the supply of the non-ejection vibration pulse NP1 to the piezoelectric actuators 43 corresponding to all the nozzles 35, and stops the non-ejection vibration of the piezoelectric actuator 43. Thereafter, in step S7, the printer controller 210 performs the maintenance processing. That is, even when the temperature of the ink in the pressure chamber 44 detected by the temperature detection section 219 is lower than the threshold value, the printer controller 210 stops the supply of the non-ejection vibration pulse NP1 to the piezoelectric actuator 43 during the maintenance processing is performed.

Further, when it is determined in step S5 that the maintenance processing is not necessary (step S5: No), steps S6 and S7 are skipped.

Next, it is determined in step S8 whether the power of the ink jet type recording apparatus 1 is turned off (OFF). When it is determined in step S8 that the power of the ink jet type recording apparatus 1 is turned off (step S8: Yes), the processing is completed.

In step S8, when the power of the ink jet type recording apparatus 1 is not turned off (step S8: No), the printer controller 210 determines in step S9 whether printing is started. When it is determined in step S9 that printing is not started (step S9: No), steps S2 to S9 are repeatedly performed. That is, steps S2 to S9 are processing performed in the standby period during which printing is not started.

When it is determined in step S9 that printing is started (step S9: Yes), in step S10, the printer controller 210 determines whether the temperature of the ink in the pressure chamber 44 detected by the temperature detection section 219 is equal to or higher than the threshold value. In step S10, when the temperature of the ink in the pressure chamber 44 detected by the temperature detection section 219 is equal to or higher than the threshold value (step S10: Yes), it is not necessary to heat the ink in the pressure chamber 44, and thus in step S11, the printer controller 210 controls the drive circuit 52 such that the non-ejection vibration pulse NP1 is not supplied to the piezoelectric actuator 43. Therefore, heat generation caused by driving the piezoelectric actuator 43, that is, heating of the ink is not performed.

In step S10, when the temperature of the ink in the pressure chamber 44 detected by the temperature detection section 219 is lower than the predetermined temperature (hereinafter, referred to as the threshold value) (step S10: No), in step S12, the printer controller 210 controls the drive circuit 52 such that the non-ejection vibration pulse NP1 is supplied to the piezoelectric actuator 43. Therefore, the piezoelectric actuator 43 generates heat by non-ejection vibration due to the non-ejection vibration pulse NP1, and the ink inside the ejection section 2 is heated.

Next, in step S13, the printer controller 210 determines whether the ejection section 2 is positioned in the printing region A. When it is determined in step S13 that the ejection section 2 is positioned in the non-printing region B (step S13: No), steps S10 to S13 are repeatedly performed. That is, the controls of the supply of the non-ejection vibration pulse NP1 in step S10 to step S13 are performed when the ejection section 2 is positioned in the non-printing region B.

When it is determined in step S13 that the ejection section 2 is positioned in the printing region A (step S13: Yes), in step S14, the printer controller 210 controls the drive circuit 52 such that the in-printing non-ejection vibration pulse NP2 is supplied to the piezoelectric actuator 43 corresponding the nozzle 35 which does not eject the ink droplets. That is, in the printer controller 210 controls the drive circuit 52 such that the ejection vibration pulse DP is supplied to the piezoelectric actuator 43 corresponding to the nozzle 35 which ejects the ink droplets for printing the image on the printing medium S in accordance with the printing data within one pixel (also referred to as one cycle) in the printing operation period. Also, in the printer controller 210 controls the drive circuit 52 such that the in-printing non-ejection vibration pulse NP2 is supplied to the piezoelectric actuator 43 corresponding to the nozzle 35 which does not eject the ink droplets in accordance with the printing data within one pixel (also referred to as one cycle) in the printing operation period. Therefore, even in the printing period, the ink in the ejection section 2 can be heated by supplying the in-printing non-ejection vibration pulse NP2 to the piezoelectric actuator 43 corresponding to the nozzle 35, which does not eject the ink droplets, to cause the piezoelectric actuator 43 non-ejection vibrate to generate heat.

Next, in step S15, the printer controller 210 determines whether printing is completed. When it is determined in step S15 that printing is not completed (step S15: No), steps S13 to S15 are repeatedly performed.

When it is determined in step S15 that printing is completed (step S15: Yes), steps S2 to S9 are repeatedly performed until next printing is started.

As described above, the ink jet type recording apparatus 1, which is an example of the liquid ejecting apparatus of the present embodiment, includes the ejection section 2 including the nozzle 35 that ejects the ink as the liquid, the pressure chamber 44 that communicates with the nozzle 35, and the piezoelectric actuator 43 that imparts the pressure fluctuation to the ink in the pressure chamber 44. Further, the ink jet type recording apparatus 1 includes the drive signal generation section 216 which is the drive waveform generation section that generates the first drive signal COM1 which is the drive waveform including the non-ejection vibration pulse NP1 which, when supplied to the piezoelectric actuator 43, imparts the pressure fluctuation to the ink in the pressure chamber 44 such that the ink is not ejected from the nozzle 35. Further, the ink jet type recording apparatus 1 includes the printer controller 210 which is the control section that controls the supply of the non-ejection vibration pulse NP1 to the piezoelectric actuator 43 in accordance with the temperature of the ink in the pressure chamber 44.

As described above, the piezoelectric actuator 43 is caused to non-ejection vibrate by the non-ejection vibration pulse NP1, the ink in the ejection section 2 is heated and stirred, the variation in the temperature of the ink is suppressed, and the ink in the ejection section 2 is maintained at the predetermined temperature, so that the ink droplets can be ejected with stable ejection characteristics. As a result, it is possible to suppress the variation in the ejection characteristics of the ink droplets due to the temperature change of the ink and suppress the deterioration of a printed image quality. Further, since the piezoelectric actuator 43 can be caused to non-ejection vibrate to heat the ink in the pressure chamber 44, a heater or the like which heats the ink is not necessary, complication of the configuration of the ink jet type recording apparatus 1 can be suppressed, the space for providing a heater or the like is not necessary, and the size of the ink jet type recording apparatus 1 can be reduced.

Further, the ink jet type recording apparatus 1 of the present embodiment includes the drive circuit 52 which is the selection section that selects one of the supply and the non-supply of the non-ejection vibration pulse NP1 to the piezoelectric actuator 43, and the temperature detection section 219 that detects the temperature of the ink as the liquid. Further, it is preferable that the printer controller 210, which is the control section, control the drive circuit 52 such that the non-ejection vibration pulse NP1 is supplied to the piezoelectric actuator 43 when the result of detection by the temperature detection section 219 is lower than the predetermined temperature, and the non-ejection vibration pulse NP1 is not supplied to the piezoelectric actuator 43 when the result of detection by the temperature detection section 219 is equal to or higher than the predetermined temperature. As described above, the printer controller 210 controls the drive circuit 52 such that the non-ejection vibration pulse NP1 is supplied to the piezoelectric actuator 43 in accordance with the temperature of the ink in the pressure chamber 44 detected by the temperature detection section 219, so that the temperature of the ink in the pressure chamber 44 can be maintained at the predetermined temperature. That is, when the result of detection by the temperature detection section 219 is equal to or higher than the predetermined temperature, the printer controller 210 does not supply the non-ejection vibration pulse NP1 to the piezoelectric actuator 43, so that heating of the ink in the pressure chamber 44 to the temperature higher than the predetermined temperature can be suppressed, and the occurrence of the variation in the temperature of the ink in the pressure chamber 44 can be suppressed. Therefore, the temperature of the ink can be maintained at the predetermined temperature and the variation in the ejection characteristics of the ink droplets can be suppressed.

Further, the ink jet type recording apparatus 1 of the present embodiment includes the wiper 10 and the cap 11 which are the maintenance sections that perform the maintenance processing of discharging the ink as the liquid in the ejection section 2. Then, it is preferable that the printer controller 210, which is the control section, control the drive circuit 52 which is the selection section, before performing the maintenance processing, such that even when the result of detection by the temperature detection section 219 is lower than the predetermined temperature, the non-ejection vibration pulse NP1 is not supplied to the piezoelectric actuator 43. As described above, when the maintenance processing, that is, the wiping processing of wiping the nozzle surface 37 with the wiper 10 is performed, the non-ejection vibration pulse NP1 is not supplied to the piezoelectric actuator 43, so that breaking of the meniscus of the ink in the nozzle 35 due to the wiping processing can be suppressed, and the occurrence of the ejection failure of the ink droplets can be suppressed.

As described above, the ink jet type recording apparatus 1, which is an example of the liquid ejecting apparatus of the present embodiment, includes the ejection section 2 including the nozzle 35 that ejects the ink as the liquid, the pressure chamber 44 that communicates with the nozzle 35, and the piezoelectric actuator 43 that imparts the pressure fluctuation to the ink in the pressure chamber 44. Further, the ink jet type recording apparatus 1 includes the drive signal generation section 216 which is the drive waveform generation section that generates the drive signal which is the drive waveform. Further, the drive signal generation section 216 generates the first drive signal COM1 which is the first drive waveform including the non-ejection vibration pulse NP1 which, when supplied to the piezoelectric actuator 43, imparts the pressure fluctuation to the ink in the pressure chamber 44 such that the ink is not ejected from the nozzle 35. Further, the drive signal generation section 216 generates the second drive signal COM2, which is the second drive waveform including the in-printing non-ejection vibration pulse NP2 which, when supplied to the piezoelectric actuator 43, imparts the pressure fluctuation to the ink in the pressure chamber 44 such that the ink is not ejected from the nozzle 35, and the ejection vibration pulse DP which, when supplied to the piezoelectric actuator 43, imparts the pressure fluctuation to the ink in the pressure chamber 44 such that the ink is ejected from the nozzle. Further, the ink jet type recording apparatus 1 includes the drive circuit 52 including the selection section that selects one of the supply and the non-supply of the drive signal, which is the drive waveform, to the piezoelectric actuator 43, and the temperature detection section 219 that detects the temperature of the ink. Further, the ink jet type recording apparatus 1 includes the printer controller 210 which is the control section that controls the drive circuit 52 such that one of the in-printing non-ejection vibration pulse NP2 and the ejection vibration pulse DP is supplied to the piezoelectric actuator 43 in accordance with the printing data in the printing operation period during which the image is printed on the printing medium S in accordance with the printing data. Further, the printer controller 210 controls the drive circuit 52 such that the non-ejection vibration pulse NP1 is supplied to the piezoelectric actuator 43 in accordance with the result of detection by the temperature detection section 219 in the standby period other than the printing operation period.

As described above, the piezoelectric actuator 43 is caused to non-ejection vibrate by the non-ejection vibration pulse NP1 in the standby period, the ink in the ejection section 2 is heated and stirred, the variation in the temperature of the ink is suppressed, and the ink in the ejection section 2 is maintained at the predetermined temperature, so that the ink droplets can be ejected with stable ejection characteristics. As a result, it is possible to suppress the variation in the ejection characteristics of the ink droplets due to the temperature change of the ink and suppress the deterioration of a printed image quality. Further, since the piezoelectric actuator 43 can be caused to non-ejection vibrate to heat the ink in the pressure chamber 44, a heater or the like which heats the ink or a mechanism that circulates the heated ink is not necessary, complication of the configuration of the ink jet type recording apparatus 1 can be suppressed, the space for providing a heater or the like is not necessary, and the size of the ink jet type recording apparatus 1 can be reduced. Further, since the temperature of the ink in the ejection section 2 can be maintained at the predetermined temperature in the standby period, the time from receiving a printing start command to starting the printing operation can be shortened.

Also, even in the printing operation period, the piezoelectric actuator 43 corresponding to the nozzle 35 which does not eject the ink droplets is caused to non-ejection vibrate by the in-printing non-ejection vibration pulse NP2, so that even in the printing operation period, the ink in the ejection section 2 is heated and stirred, the variation in the temperature of the ink is suppressed, and the ink in the ejection section 2 is maintained at the predetermined temperature, so that the ink droplets can be ejected with stable ejection characteristics. As a result, it is possible to suppress the variation in the ejection characteristics of the ink droplets due to the temperature change of the ink and suppress the deterioration of a printed image quality. In particular, by heating the ink by causing the piezoelectric actuator 43 corresponding to a pause nozzle that does not eject the ink droplets to non-ejection vibrate by the in-printing non-ejection vibration pulse NP2, the variation in the image quality with respect to an environmental temperature can be suppressed in large format printing, mass printing, printing centered on character and line drawings in which a pause time of the pause nozzle that does not eject the ink droplets during printing is increased, or CAD printing. In addition, by heating the ink by causing the piezoelectric actuator 43 corresponding to the pause nozzle that does not eject the ink droplets to non-ejection vibrate by the in-printing non-ejection vibration pulse NP2, the variation in the image quality with respect to the environmental temperature can be suppressed in high-quality printing, multi-pass printing such as printing on curved surfaces of three-dimensional objects, or time-consuming printing such as unidirectional and low-speed printing.

Further, since the non-ejection vibration pulse NP1 in the standby period and the in-printing non-ejection vibration pulse NP2 in the printing operation period can have different drive waveforms, the non-ejection vibration pulse NP1 and the in-printing non-ejection vibration pulse NP2 can be optimized depending on the conditions. Since the non-ejection vibration pulse NP1 is supplied to the piezoelectric actuator 43 in the standby period, for example, the non-ejection vibration pulse NP1 may be repeatedly generated in a short cycle such that the ink in the ejection section 2 is heated in a short time, or two or more of a plurality of the non-ejection vibration pulses NP1 may be provided in one recording cycle T. Further, since the in-printing non-ejection vibration pulse NP2 is supplied to the piezoelectric actuator 43 in the printing operation period, for example, a design need only be made based on a resonance period Tc (Helmholtz vibration period Tc) of the pressure chamber 44 such that the ejection vibration pulse DP of the next ink droplets is not affected.

Further, in the ink jet type recording apparatus 1 of the present embodiment, it is preferable that the printer controller 210, which is the control section, start, based on the power-on operation of the ink jet type recording apparatus 1, the control of the supply of the non-ejection vibration pulse NP1 corresponding to the temperature of the ink as the liquid. Accordingly, since the ink in the ejection section 2 can be maintained at the predetermined temperature immediately after the power of the ink jet type recording apparatus 1 is turned on, the standby period from receiving the printing command to starting printing can be shortened as compared to when the ink is heated after receiving the printing command.

Further, in the ink jet type recording apparatus 1 of the present embodiment, it is preferable that the printer controller 210, which is the control section, stop, based on the power-off operation of the ink jet type recording apparatus 1, the control of the supply of the non-ejection vibration pulse NP1 corresponding to the temperature of the ink as the liquid. Accordingly, wasteful electric power consumption can be suppressed by stopping the control of the supply of the non-ejection vibration pulse NP1 when the power supply of the ink jet type recording apparatus 1 is turned off.

Further, in the ink jet type recording apparatus 1 of the present embodiment, it is preferable that in the standby period, the printer controller 210, which is the control section, control the drive circuit 52, which is the selection section, such that the non-ejection vibration pulse NP1 is supplied to the piezoelectric actuator 43 when the result of detection by the temperature detection section 219 is lower than the predetermined temperature, and the non-ejection vibration pulse NP1 is not supplied to the piezoelectric actuator 43 when the result of detection by the temperature detection section 219 is equal to or higher than the predetermined temperature. As described above, the printer controller 210 controls the drive circuit 52 such that the non-ejection vibration pulse NP1 is supplied to the piezoelectric actuator 43 in accordance with the temperature of the ink in the pressure chamber 44 detected by the temperature detection section 219, so that the temperature of the ink in the pressure chamber 44 can be maintained at the predetermined temperature. That is, when the result of detection by the temperature detection section 219 is equal to or higher than the predetermined temperature, the printer controller 210 does not supply the non-ejection vibration pulse NP1 to the piezoelectric actuator 43, so that heating of the ink in the pressure chamber 44 to the temperature higher than the predetermined temperature can be suppressed, and the occurrence of the variation in the temperature of the ink in the pressure chamber 44 can be suppressed. Therefore, the temperature of the ink can be maintained at the predetermined temperature and the variation in the ejection characteristics of the ink droplets can be suppressed.

As described above, in the present embodiment, since the ink in the ejection section 2 can be heated by the non-ejection vibration pulse NP1 or the in-printing non-ejection vibration pulse NP2, as the ink used for the ejection section 2, an ultraviolet curable ink or a solvent-based ink can be used. That is, the ultraviolet curable ink or the solvent-based ink has a relatively high viscosity at room temperature, but the viscosity can be decreased by heating the ink having the high viscosity with the non-ejection vibration pulse NP1 or the in-printing non-ejection vibration pulse NP2, and thus decreasing of the ejection characteristics of the ink droplets can be suppressed.

Note that the solvent-based ink is an ink in which a main component of the solvent is an organic solvent, and is also called a solvent ink or a non-aqueous ink. The solvent-based ink is an ink which contains any one or more of glycol ethers, glycol ether esters, dibasic acid esters, an ester-based solvent, a hydrocarbon-based solvent, and an alcohol-based solvent. Further, the ultraviolet curable ink is, for example, a UV ink which contains a monomer or an oligomer that is cured by causing a polymerization reaction by irradiation with ultraviolet rays. Examples of a composition of the ultraviolet curable ink include inks containing any one of (meth)acrylates, (meth)acrylamides, and an N-vinyl compound as a polymerizable compound.

Note that in the first embodiment described above, when the temperature detected by the temperature detection section 219 is equal to or higher than the threshold value, the in-printing non-ejection vibration pulse NP2 is controlled to be supplied to the piezoelectric actuator 43, but the present disclosure is not particularly limited to this. For example, the drive signal generation section 216 may correct and generate the in-printing non-ejection vibration pulse NP2 such that a calorific value of the piezoelectric actuator 43 differs based on the temperature of the ink in the pressure chamber 44 detected by the temperature detection section 219. Here, the in-printing non-ejection vibration pulse NP2 corrected by the drive signal generation section 216 will be described with reference to FIG. 9. Note that FIG. 9 illustrates the drive waveform indicating the correction of the in-printing non-ejection vibration pulse NP2.

The drive signal generation section 216 generates the in-printing non-ejection vibration pulse such that the calorific value of the piezoelectric actuator 43 caused by the in-printing non-ejection vibration pulse NP2 when the temperature is lower than the predetermined temperature of the ink in the pressure chamber 44, which is the reference, is larger than the calorific value of the piezoelectric actuator 43 caused by the in-printing non-ejection vibration pulse NP2 when the temperature is equal to or higher than the predetermined temperature. That is, when the temperature of the ink in the pressure chamber 44 detected by the temperature detection section 219 is lower than the predetermined temperature, the viscosity of the ink in the pressure chamber 44 is high and the ink needs to be heated relatively much, and thus the in-printing non-ejection vibration pulse NP2 is corrected and generated such that the calorific value of the heat generated from the piezoelectric actuator 43 becomes large. Further, when the temperature of the ink in the pressure chamber 44 detected by the temperature detection section 219 is equal to or higher than the predetermined temperature, the viscosity of the ink in the pressure chamber 44 is low and the ink may be heated relatively little, and thus the in-printing non-ejection vibration pulse NP2 is corrected and generated such that the calorific value of the heat generated from the piezoelectric actuator 43 is small.

Figure 9:
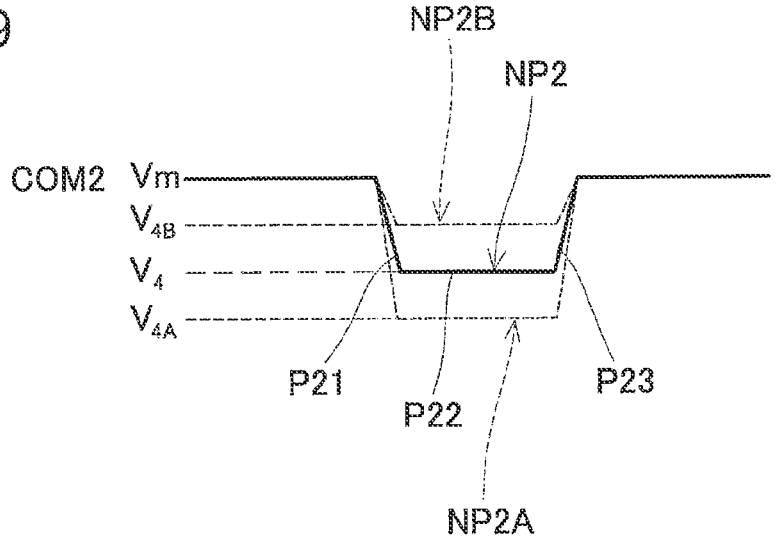
FIG. 9 illustrates a drive waveform indicating correction of an in-printing non-ejection vibration pulse.

Specifically, as illustrated in FIG. 9, when the temperature of the ink in the pressure chamber detected by the temperature detection section 219 is within a predetermined temperature range, the drive signal generation section 216 generates the in-printing non-ejection vibration pulse NP2 which is the standard, and supplies the standard in-printing non-ejection vibration pulse NP2 to the piezoelectric actuator 43.

On the other hand, when the temperature detected by the temperature detection section 219 is lower than the predetermined temperature range, the drive signal generation section 216 generates an in-printing non-ejection vibration pulse NP2A in which a potential difference with the intermediate potential Vm as the reference is a fourth potential $V_{4A}$ larger than the fourth potential $V_4$ of the standard in-printing non-ejection vibration pulse NP2 such that the pulse amplitude is larger than the standard in-printing non-ejection vibration pulse NP2. When the piezoelectric actuator 43 is driven by the in-printing non-ejection vibration pulse NP2A, the calorific value generated by the piezoelectric actuator 43 is larger than when the piezoelectric actuator 43 is driven by the standard in-printing non-ejection vibration pulse NP2. Therefore, when the temperature of the ink in the pressure chamber 44 is lower than the predetermined temperature range, the calorific value of the piezoelectric actuator 43 is increased by the in-printing non-ejection vibration pulse NP2A, so that the ink temperature can be heated to a desired temperature for a short time. That is, even when the temperature of the ink in the pressure chamber 44 is lower than the predetermined temperature range, even when the piezoelectric actuator 43 is driven by the standard in-printing non-ejection vibration pulse NP2, the calorific value generated by the piezoelectric actuator 43 is small, and it takes time for the ink to reach the desired temperature.

Further, when the temperature detected by the temperature detection section 219 is equal to or higher than the predetermined temperature range, the drive signal generation section 216 generates an in-printing non-ejection vibration pulse NP2B in which a potential difference with the intermediate potential Vm as the reference is a fourth potential $V_{4B}$ smaller than the fourth potential $V_4$ of the standard in-printing non-ejection vibration pulse NP2 such that the pulse amplitude is smaller than the standard in-printing non-ejection vibration pulse NP2. When the piezoelectric actuator 43 is driven by the in-printing non-ejection vibration pulse NP2B, the calorific value generated by the piezoelectric actuator 43 is smaller than when the piezoelectric actuator 43 is driven by the standard in-printing non-ejection vibration pulse NP2. Therefore, when the temperature of the ink in the pressure chamber 44 is equal to or higher than the predetermined temperature range, the calorific value of the piezoelectric actuator 43 is decreased by the in-printing non-ejection vibration pulse NP2B, so that the ink temperature can be heated to the desired temperature. That is, even when the temperature of the ink in the pressure chamber 44 is equal to or higher than the predetermined temperature range, when the piezoelectric actuator 43 is driven by the standard in-printing non-ejection vibration pulse NP2, the calorific value generated by the piezoelectric actuator 43 is large, and the temperature of the ink may be higher than the desired temperature.

Note that in the example illustrated in FIG. 9, the piezoelectric actuator is driven by the standard in-printing non-ejection vibration pulse NP2 in the predetermined temperature range, but the present disclosure is not particularly limited to this. For example, the predetermined temperature is a single value, the in-printing non-ejection vibration pulse NP2A may be generated when the temperature of the ink in the pressure chamber 44 detected by the temperature detection section 219 is equal to or higher than the predetermined temperature, and the in-printing non-ejection vibration pulse NP2B may be generated when the temperature of the ink in the pressure chamber 44 detected by the temperature detection section 219 is lower than the predetermined temperature. That is, the "predetermined temperature" may be a temperature having a value within a predetermined range or a temperature having a single value.

As described above, it is preferable that the drive signal generation section 216, which is the drive waveform generation section, generate the in-printing non-ejection vibration pulse NP2 in the printing operation period such that the calorific value of the piezoelectric actuator 43 caused by the in-printing non-ejection vibration pulse NP2 when the result of detection by the temperature detection section 219 is lower than the predetermined temperature is larger than the calorific value of the piezoelectric actuator 43 caused by the in-printing non-ejection vibration pulse NP2 when the result of detection by the temperature detection section 219 is equal to or higher than the predetermined temperature.

As described above, the drive signal generation section 216 corrects and generates the in-printing non-ejection vibration pulse NP2 based on the temperature of the ink in the pressure chamber 44 detected by the temperature detection section 219, so that the temperature of the ink in the ejection section 2 can be more finely controlled. Therefore, the temperature of the ink in the ejection section 2 can be maintained with high accuracy. Therefore, the temperature of the ink, that is, the viscosity of the ink can be controlled with high accuracy, and the variation in the ejection characteristics of the ink droplets can be suppressed.

Note that in the above example, the drive signal generation section 216 adjusts the fourth potential $V_4$ of the in-printing non-ejection vibration pulse NP2 to adjust the application voltage applied to the piezoelectric actuator 43, but the present disclosure is not particularly limited to this. Since the application voltage is defined by the potential difference between the fourth potential $V_4$ and the intermediate potential Vm, for example, the application voltage applied to the piezoelectric actuator 43 may be adjusted by adjusting the intermediate potential Vm. That is, when the temperature of the ink detected by the temperature detection section 219 is lower than the predetermined temperature, the drive signal generation section 216 need only correct and generate the in-printing non-ejection vibration pulse NP2 such that the application voltage applied to the piezoelectric actuator 43 becomes large.

Further, the drive signal generation section 216 may adjust the calorific value of the piezoelectric actuator 43 by adjusting the inclination of the second non-ejection expansion element P21 of the in-printing non-ejection vibration pulse NP2. That is, when the temperature detected by the temperature detection section 219 is lower than the predetermined temperature range, the drive signal generation section 216 need only correct and generate the in-printing non-ejection vibration pulse NP2 such that the inclination of the second non-ejection expansion element P21 becomes large.

Further, when the temperature of the ink detected by the temperature detection section 219 is lower than the predetermined temperature, the drive signal generation section 216 may generate two or more of a plurality of the in-printing non-ejection vibration pulses NP2 within one recording cycle T such that the calorific value of the piezoelectric actuator 43 becomes large. That is, when the temperature of the ink detected by the temperature detection section 219 is lower than the predetermined temperature, the drive signal generation section 216 increases the number of in-printing non-ejection vibration pulses NP2 generated within one recording cycle T to increase the calorific value of the piezoelectric actuator 43. Further, when the temperature of the ink detected by the temperature detection section 219 is equal to or higher than the predetermined temperature, the drive signal generation section 216 decreases the number of in-printing non-ejection vibration pulses NP2 generated within one recording cycle T to decrease the calorific value of the piezoelectric actuator 43. That is, the calorific value of the piezoelectric actuator 43 referred in here is the calorific value per unit time (1 recording cycle T).

Needless to say, the generation, by the drive signal generation section 216, of the in-printing non-ejection vibration pulse NP2 corresponding to the temperature detected by the temperature detection section 219 is not limited to two-step and three-step generation of in-printing non-ejection vibration pulse NP2 as described above, and may have four or more steps.

Note that the drive signal generation section 216 may correct the ejection vibration pulse DP based on the temperature of the ink in the pressure chamber 44 detected by the temperature detection section 219, similarly to the in-printing non-ejection vibration pulse NP2. That is, when the temperature of the ink in the pressure chamber 44 detected by the temperature detection section 219 is lower than the predetermined temperature, the drive signal generation section 216 need only correct the ejection vibration pulse DP such that the application voltage defined by the potential difference between the second potential $V_2$ and the third potential $V_3$ of the first contraction element P13 becomes relatively large. Also, when the temperature of the ink in the pressure chamber 44 detected by the temperature detection section 219 is equal to or higher than the predetermined temperature, the drive signal generation section 216 need only correct the ejection vibration pulse DP such that the application voltage defined by the potential difference between the second potential $V_2$ and the third potential $V_3$ of the first contraction element P13 becomes relatively small. Needless to say, even in the ejection vibration pulse DP, the inclination of the first contraction element P13 may be adjusted in the same manner as in the in-printing non-ejection vibration pulse NP2.

Second Embodiment

Figure 10:
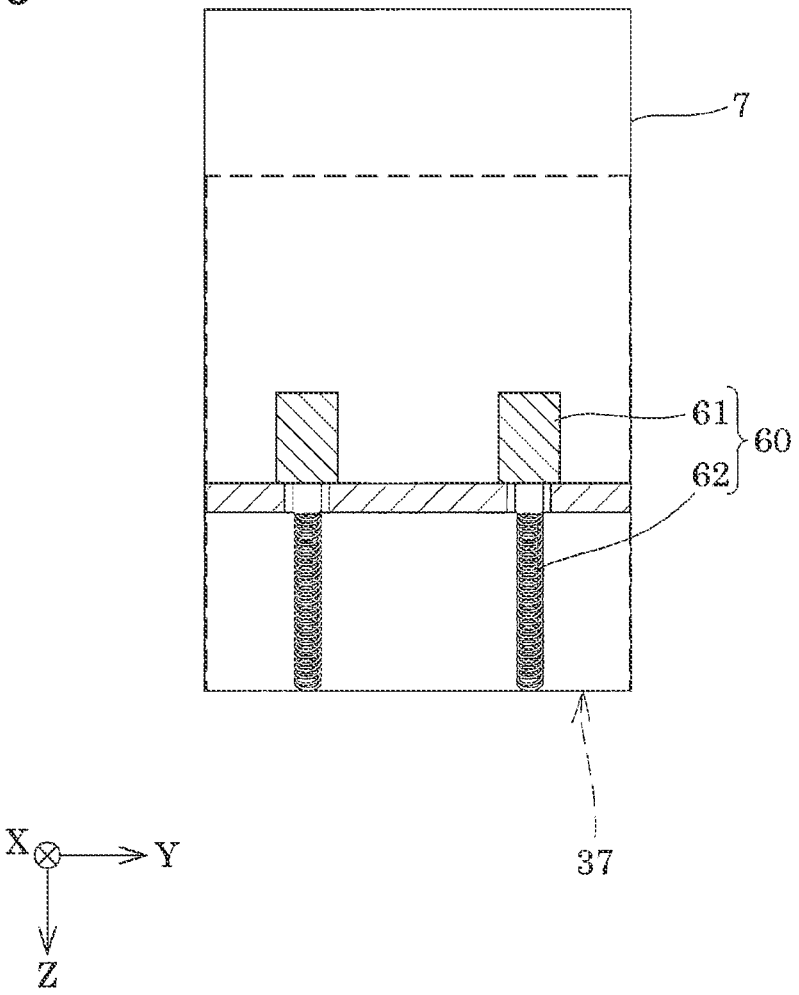
FIG. 10 is a sectional view of a main portion of the recording apparatus.
Figure 11:
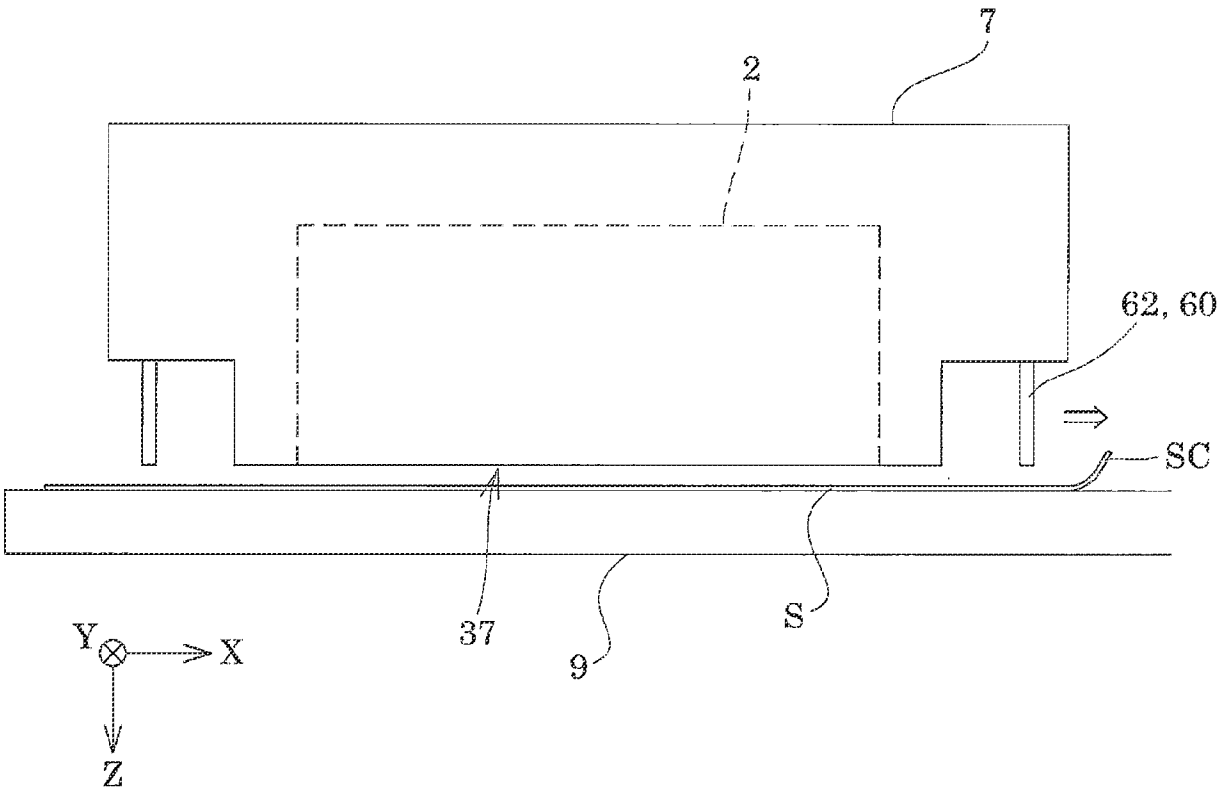
FIG. 11 is a side view of the main portion of the recording apparatus.
Figure 12:
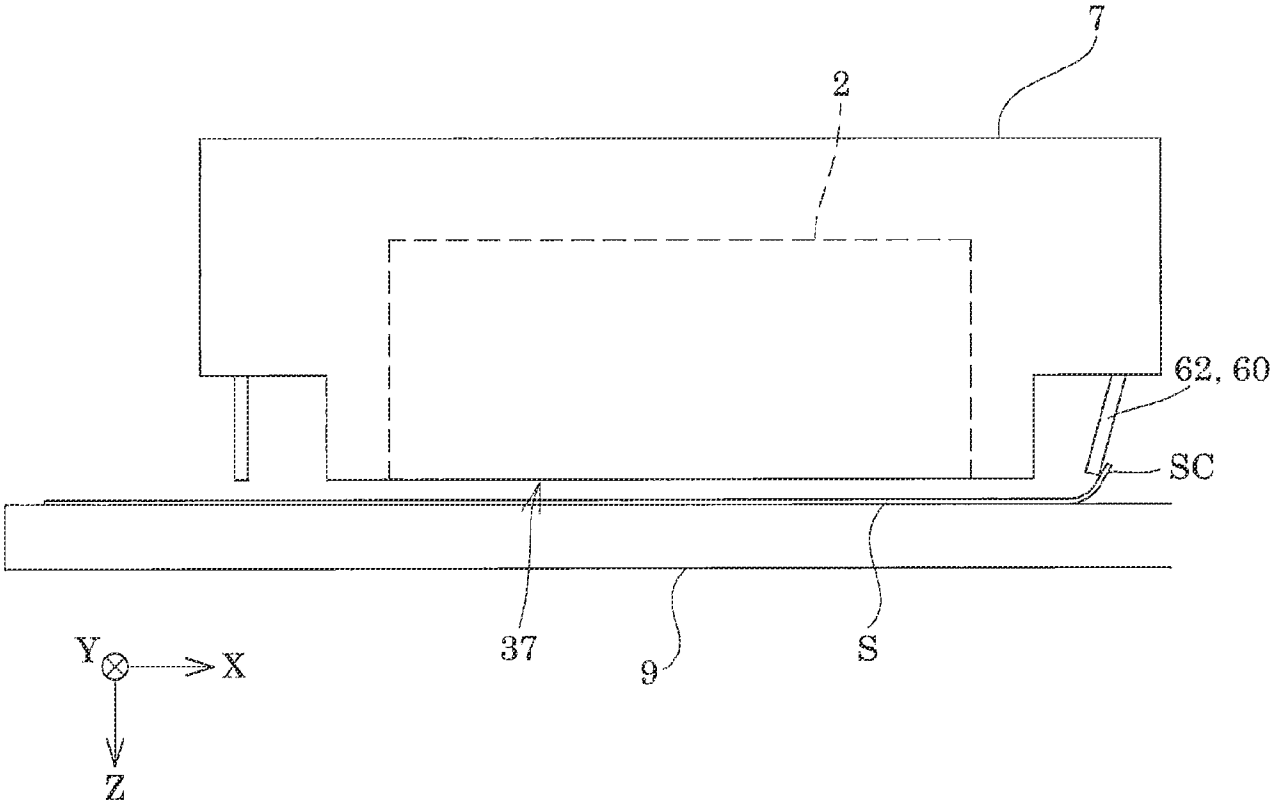
FIG. 12 is a side view of the main portion of the recording apparatus.

FIG. 10 is a sectional view of a main portion of the main part of the ink jet type recording apparatus 1 which is an example of the liquid ejecting apparatus according to a second embodiment of the present disclosure. FIGS. 11 and 12 are side views of a main portion of the ink jet type recording apparatus 1 according to the second embodiment.

As illustrated in FIGS. 10 and 11, the ink jet type recording apparatus 1 is provided with a contact object detection section 60 that detects an object having a possibility of coming into contact with the nozzle surface 37 on which the nozzle 35 of the ejection section 2 is open.

The contact object detection section 60 includes a main body 61 and a flexible rod 62 formed by a coil spring or the like of which a base end portion is fixed to the main body 61. Such a contact object detection section 60 includes a limit switch that detects that the object comes into contact with the flexible rod 62 and the flexible rod 62 is tilted. Two contact object detection sections 60 are provided on each of both sides of the +X direction and the −X direction, which are the moving directions of the transport body 7, that is, four in total. That is, the contact object detection sections 60 are disposed on the X axis with the ejection section 2 interposed therebetween. Two contact object detection sections 60 provided on each of both sides in the +X direction and the −X direction of the transport body 7 are arranged along the +Y direction.

Each contact object detection section 60 is disposed such that a tip of the flexible rod 62 is at the same height as the nozzle surface 37 of the ejection section 2 held by the transport body 7 on the Z axis. Therefore, for example, as illustrated in FIG. 11, even when the end portion of the printing medium S is warped to a height at which the end portion comes into contact with the nozzle surface 37 in the −Z direction and an end portion Sc of the printing medium S may come into contact with the nozzle surface 37 due to the movement of the transport body 7, as illustrated in FIG. 12, the flexible rod 62 of the contact object detection section 60 tilts due to contacting with the end portion of the printing medium S before the nozzle surface 37 comes into contact with the end portion Sc of the printing medium S, and the contact object is detected. Therefore, the contact object detection section can detect the contact object having the possibility of coming into contact with the nozzle surface.

The contact object detection section 60 of the present embodiment can also function as the detection section that detects the object that hinders the movement of the transport body 7 along the X axis.

Note that in the present embodiment, as the contact object detection section 60, a switch-shaped section that detects the object which comes into contact with the flexible rod 62 by tilting the flexible rod 62 is used, but the present disclosure is not particularly limited to this, for example, a non-contact type sensor such as an infrared sensor, a capacitance sensor, or an optical sensor can be used. Also, the contact object detection section 60 may detect the wiping operation by the wiper 10.

Then, when the contact object detection section 60 detects the contact object having the possibility of coming into contact with the nozzle surface 37, the printer controller 210 controls the piezoelectric actuator 43 such that the non-ejection vibration pulse NP1 is not supplied. As a result, it is possible to suppress the breaking of the meniscus of the ink in the nozzle 35 and suppress the occurrence of so-called nozzle omission in which the ink droplets are not ejected during printing.

Similarly, even in the printing operation period, when the contact object detection section 60 detects the contact object having the possibility of coming into contact with the nozzle surface 37, the printer controller 210 controls the piezoelectric actuator 43 such that the in-printing non-ejection vibration pulse NP2 is not supplied. As a result, it is possible to suppress the breaking of the meniscus of the ink in the nozzle 35 and suppress the occurrence of so-called nozzle omission in which the ink droplets are not ejected during printing.

As described above, the ink jet type recording apparatus 1 of the present embodiment includes the contact object detection section 60 that detects the object having the possibility of coming into contact with the nozzle surface 37 on which the nozzle 35 is open. Then, it is preferable that the printer controller 210, which is the control section, control the drive circuit 52, which is the selection section, such that even when the result of detection by the temperature detection section 219 is lower than the predetermined temperature, when the contact object detection section 60 detects the object having the possibility of coming into contact with the nozzle surface 37, the non-ejection vibration pulse NP1 is not supplied to the piezoelectric actuator 43. As described above, when there is the object that comes into contact with the nozzle surface 37, the non-ejection vibration pulse NP1 is not supplied to the piezoelectric actuator 43, so that breaking of the meniscus of the ink in the nozzle 35 due to the object that comes into contact with the nozzle surface 37 can be suppressed, and the occurrence of the ejection failure of the ink droplets can be suppressed.

Other Embodiments

One embodiment of the present disclosure has been described above, but the basic configuration of the present disclosure is not limited to the above.

For example, in the first embodiment described above, the non-ejection vibration pulse NP1 of the first drive signal COM1 and the ejection vibration pulse DP and the in-printing non-ejection vibration pulse NP2 of the second drive signal COM2 are repeatedly generated for each same recording cycle T, but the present disclosure is not particularly limited to this. For example, the non-ejection vibration pulse NP1 may be repeatedly generated for each cycle shorter than the recording cycle T of one pixel.

Further, the ink may be heated in the liquid container 3 or between the liquid container 3 and the ejection section 2 and supplied to the ejection section 2. Even when the heated ink is supplied to the ejection section 2 as described above, the temperature of the ink in the ejection section 2 is decreased due to the environmental temperature, so that the variation in ejection characteristics can be suppressed and the printed image quality can be improved by heating the ink in the ejection section 2 by the non-ejection vibration pulse NP1 and the in-printing non-ejection vibration pulse NP2.

Further, the piezoelectric actuator 43 of the first embodiment described above may be, for example, a thin film type piezoelectric actuator 43 laminated along the Z axis by a film forming and lithography method, or a thick film type piezoelectric actuator 43 formed by a method of adhering a green sheet. Also, the piezoelectric actuator 43 may be a longitudinal vibration type piezoelectric actuator in which a piezoelectric material and an electrode forming material are alternately laminated in a direction intersecting the Z axis and expanded and contracted in the Z axis direction.

Further, in the ink jet type recording apparatus 1 described above, an example has been described in which the ejection section 2 is installed on the transport body 7 and moves in the +X direction and the −X direction along the X axis, which are the main scanning direction, but the present disclosure is not particularly limited to this. For example, the present disclosure can be applied to a so-called line type recording apparatus that performs printing by fixing the ejection section 2 and moving the printing medium S in the +Y direction, which is a sub scanning direction.

Further, in the ink jet type recording apparatus 1 described above, as the change of the relative position between the ejection section 2 and the printing medium S in the +Y direction and the −Y direction, an example has been described in which the printing medium S is transported by the transport mechanism 4 along the Y axis, which is the sub scanning direction, but the present disclosure is not particularly limited to this. For example, the present disclosure can be applied to a so-called flatbed type recording apparatus that performs printing by fixing the support base 9 and the printing medium S adhered to the upper surface thereof, moving the ejection section 2 by the moving mechanism 6 in the +X direction and −X direction along the X axis, and moving the moving mechanism 6 in the +Y direction, which is the sub scanning direction, along the guide rail (not illustrated) of the support base 9 along the Y axis.

Further, the present disclosure is intended for a wide range of liquid ejecting apparatus in general, and can be applied to, for example, a liquid ejecting apparatus using an ejection section such as a recording head such as various ink jet type recording heads used in image recording apparatuses such as printers, a color material ejection head used in the manufacture of a color filter of a liquid crystal display, an electrode material ejection head used for electrode formation of an organic EL display, a field emission display (FED), or a bioorganic matter ejection head used for biochip manufacture.

What is claimed is:

1. A liquid ejecting apparatus comprising:

an ejection section that includes a nozzle which ejects a liquid, a pressure chamber which communicates with the nozzle, and a piezoelectric actuator which is configured to impart a pressure fluctuation to the liquid in the pressure chamber;

a drive waveform generation section that is configured to generate a drive waveform including a non-ejection vibration pulse which, when supplied to the piezoelectric actuator, imparts the pressure fluctuation to the liquid in the pressure chamber such that the liquid is not ejected from the nozzle;

a selection section that is configured to select one of supply and non-supply of the non-ejection vibration pulse to the piezoelectric actuator;

a temperature detection section that is configured to detect the temperature of the liquid;

a maintenance section that is configured to perform maintenance processing of discharging the liquid in the ejection section; and a control section that is configured to control supply of the non-ejection vibration pulse to the piezoelectric actuator in accordance with a temperature of the liquid in the pressure chamber, wherein the control section controls the selection section, before performing the maintenance processing, such that even when the result of detection by the temperature detection section is lower than a predetermined temperature, the non-ejection vibration pulse is not supplied to the piezoelectric actuator.

2. The liquid ejecting apparatus according to claim 1, wherein the control section controls the selection section such that when a result of detection by the temperature detection section is lower than the predetermined temperature, the non-ejection vibration pulse is supplied to the piezoelectric actuator and when the result of detection by the temperature detection section is equal to or higher than the predetermined temperature, the non-ejection vibration pulse is not supplied to the piezoelectric actuator.

3. The liquid ejecting apparatus according to claim 2, further comprising:

a contact object detection section that is configured to detect an object having a possibility of coming into contact with a nozzle surface on which the nozzle is open, wherein the control section controls the selection section such that even when the result of detection by the temperature detection section is lower than the predetermined temperature, in a case in which the contact object detection section detects the object having the possibility of coming into contact with the nozzle surface, the non-ejection vibration pulse is not supplied to the piezoelectric actuator.

4. The liquid ejecting apparatus according to claim 1, wherein the control section starts, based on a power-on operation of the liquid ejecting apparatus, control of supply of the non-ejection vibration pulse corresponding to the temperature of the liquid.

5. The liquid ejecting apparatus according to claim 4, wherein the control section stops, based on a power-off operation of the liquid ejecting apparatus, the control of supply of the non-ejection vibration pulse corresponding to the temperature of the liquid.

6. The liquid ejecting apparatus according to claim 1, wherein the liquid is an ultraviolet curable ink or a solvent-based ink.

7. A liquid ejecting apparatus comprising:

an ejection section that includes a nozzle which ejects a liquid, a pressure chamber which communicates with the nozzle, and a piezoelectric actuator which is configured to impart a pressure fluctuation to the liquid in the pressure chamber;

a drive waveform generation section that is configured to generate drive waveforms including a first drive waveform including a non-ejection vibration pulse which, when supplied to the piezoelectric actuator, imparts the pressure fluctuation to the liquid in the pressure chamber such that the liquid is not ejected from the nozzle and a second drive waveform including an in-printing non-ejection vibration pulse which, when supplied to the piezoelectric actuator, imparts the pressure fluctuation to the liquid in the pressure chamber such that the liquid is not ejected from the nozzle and an ejection vibration pulse which, when supplied to the piezoelectric actuator, imparts the pressure fluctuation to the liquid in the pressure chamber such that the liquid is ejected from the nozzle;

a selection section that is configured to select one of supply and non-supply of the drive waveforms to the piezoelectric actuator;

a temperature detection section that is configured to detect a temperature of the liquid;

a maintenance section that is configured to perform maintenance processing of discharging the liquid in the ejection section; and a control section that is configured to control the selection section, in a printing operation period during which an image is printed on a printing medium in accordance with printing data, such that one of the in-printing non-ejection vibration pulse and the ejection vibration pulse is supplied to the piezoelectric actuator in accordance with the printing data and controls the selection section, in a standby period other than the printing operation period, such that the non-ejection vibration pulse is supplied to the piezoelectric actuator in accordance with a result of detection by the temperature detection section, wherein the control section controls the selection section, before performing the maintenance processing, such that even when the result of detection by the temperature detection section is lower than a predetermined temperature, the non-ejection vibration pulse is not supplied to the piezoelectric actuator.

8. The liquid ejecting apparatus according to claim 7, wherein the control section starts, based on a power-on operation of the liquid ejecting apparatus, control of supply of the non-ejection vibration pulse corresponding to the temperature of the liquid.

9. The liquid ejecting apparatus according to claim 8, wherein the control section stops, based on a power-off operation of the liquid ejecting apparatus, the control of supply of the non-ejection vibration pulse corresponding to the temperature of the liquid.

10. The liquid ejecting apparatus according to claim 7, wherein the control section controls the selection section, in the standby period, such that when the result of detection by the temperature detection section is lower than the predetermined temperature, the non-ejection vibration pulse is supplied to the piezoelectric actuator and when the result of detection by the temperature detection section is equal to or higher than the predetermined temperature, the non-ejection vibration pulse is not supplied to the piezoelectric actuator.

11. The liquid ejecting apparatus according to claim 7, wherein the drive waveform generation section generates the in-printing non-ejection vibration pulse, in the printing operation period, such that a calorific value of the piezoelectric actuator caused by the in-printing non-ejection vibration pulse when the result of detection by the temperature detection section is lower than the predetermined temperature is larger than a calorific value of the piezoelectric actuator caused by the in-printing non-ejection vibration pulse when the result of detection by the temperature detection section is equal to or higher than the predetermined temperature.

12. The liquid ejecting apparatus according to claim 7, wherein the liquid is an ultraviolet curable ink or a solvent-based ink.

13. A drive method of a liquid ejecting apparatus including an ejection section that includes a nozzle which ejects a liquid, a pressure chamber which communicates with the nozzle, and a piezoelectric actuator which is configured to impart a pressure fluctuation to the liquid in the pressure chamber a drive waveform generation section that is configured to generate a drive waveform including a non-ejection vibration pulse which, when supplied to the piezoelectric actuator, imparts the pressure fluctuation to the liquid in the pressure chamber such that the liquid is not ejected from the nozzle, a selection section that is configured to select one of supply and non-supply of the non-ejection vibration pulse to the piezoelectric actuator, a temperature detection section that is configured to detect the temperature of the liquid, and a maintenance section that is configured to perform maintenance processing of discharging the liquid in the ejection section, the method comprising:

controlling supply of the non-ejection vibration pulse to the piezoelectric actuator in accordance with a temperature of the liquid in the pressure chamber, wherein the selection section is controlled before performing the maintenance processing, such that even when the result of detection by the temperature detection section is lower than a predetermined temperature, the non-ejection vibration pulse is not supplied to the piezoelectric actuator.

14. A drive method of a liquid ejecting apparatus including an ejection section that includes a nozzle which ejects a liquid, a pressure chamber which communicates with the nozzle, and a piezoelectric actuator which is configured to impart a pressure fluctuation to the liquid in the pressure chamber, a drive waveform generation section that is configured to generate drive waveforms including a first drive waveform including a non-ejection vibration pulse which, when supplied to the piezoelectric actuator, imparts the pressure fluctuation to the liquid in the pressure chamber such that the liquid is not ejected from the nozzle and a second drive waveform including an in-printing non-ejection vibration pulse which, when supplied to the piezoelectric actuator, imparts the pressure fluctuation to the liquid in the pressure chamber such that the liquid is not ejected from the nozzle and an ejection vibration pulse which, when supplied to the piezoelectric actuator, imparts the pressure fluctuation to the liquid in the pressure chamber such that the liquid is ejected from the nozzle, a temperature detection section that is configured to detect a temperature of the liquid, and a maintenance section that is configured to perform maintenance processing of discharging the liquid in the ejection section, the method comprising:

supplying, in a printing operation period during which an image is printed on a printing medium in accordance with printing data, one of the in-printing non-ejection vibration pulse and the ejection vibration pulse to the piezoelectric actuator in accordance with the printing data and supplying, in a standby period other than the printing operation period, the non-ejection vibration pulse to the piezoelectric actuator in accordance with a result of detection by the temperature detection section, wherein the selection section is controlled before performing the maintenance processing, such that even when the result of detection by the temperature detection section is lower than a predetermined temperature, the non-ejection vibration pulse is not supplied to the piezoelectric actuator.

* * * * *